US007637058B2

(12) United States Patent
Lai

(10) Patent No.: US 7,637,058 B2
(45) Date of Patent: Dec. 29, 2009

(54) WIND AND RAIN PREVENTING DEVICE FOR ALUMINUM DOORS AND WINDOWS

(76) Inventor: Chin-Ming Lai, 2 Fl.-1, No. 12, Minzu E. Rd., Taipei City (TW)

( * ) Notice: Subject to any disclaimer, the term of this patent is extended or adjusted under 35 U.S.C. 154(b) by 630 days.

(21) Appl. No.: 11/074,797

(22) Filed: Mar. 9, 2005

(65) Prior Publication Data

US 2006/0201066 A1 Sep. 14, 2006

(51) Int. Cl.
*E05D 13/00* (2006.01)

(52) U.S. Cl. ..... 49/425; 52/204.51; 52/209; 52/656.9; 49/408

(58) Field of Classification Search ..... 49/404, 49/408, 425, 501; 52/204.51, 209, 656.9
See application file for complete search history.

(56) References Cited

U.S. PATENT DOCUMENTS 3,175,255 A * 3/1965 Saunders ..... 49/425
3,299,575 A * 1/1967 Du Shane ..... 49/420
3,386,208 A * 6/1968 Banner ..... 49/420
3,411,247 A * 11/1968 Fleming ..... 49/501
3,442,052 A * 5/1969 Levine ..... 49/425
3,510,985 A * 5/1970 Smits ..... 49/425
3,526,995 A * 9/1970 Saunders ..... 49/420
3,619,947 A * 11/1971 Burum ..... 49/265
3,716,890 A * 2/1973 Benson ..... 16/91
3,729,868 A * 5/1973 Burum ..... 49/420
3,785,090 A * 1/1974 MacGillis ..... 49/425
3,859,754 A * 1/1975 Budich et al. ..... 49/425
4,006,513 A * 2/1977 Offterdinger ..... 16/99
4,030,160 A * 6/1977 Lambertz et al. ..... 16/105
4,189,870 A * 2/1980 Helmick ..... 49/420
4,286,716 A * 9/1981 Budich et al. ..... 206/577
4,353,186 A * 10/1982 Offterdinger ..... 49/420
4,639,970 A * 2/1987 Adams ..... 16/90
4,873,741 A * 10/1989 Riegelman ..... 16/105
5,119,872 A * 6/1992 Engebretson ..... 160/381
5,341,600 A * 8/1994 Heppner ..... 49/471
5,343,594 A * 9/1994 Harvey ..... 16/105
6,067,760 A * 5/2000 Nowell ..... 52/204.57
6,434,789 B1 * 8/2002 Kruse ..... 16/93 R
6,644,380 B2 * 11/2003 Perich et al. ..... 160/381
6,813,862 B2 * 11/2004 Perich et al. ..... 49/425
6,883,279 B2 * 4/2005 Fukuro et al. ..... 52/209

* cited by examiner

*Primary Examiner*—Jerry Redman
(74) *Attorney, Agent, or Firm*—Wang Law Firm, Inc.; Li K. Wang

(57) ABSTRACT

A wind and rain preventing device for aluminum doors and windows includes a window structure composed of an inner window, an outer window, a lower frame, two side frames and an upper frame. The wind and rain preventing device consists of plural covering-and-clogging casings, plural water-preventing elongate members, an inner draining space, a lower wind-and-rain-stopping blocks, plural draining valves, an upper wind-and-rain-stopping blocks, and plural collision-preventing and airtight elongate members. The wind and rain preventing device for aluminum doors and windows has excellent effects of prevention of wind and rain and resistance to wind pressure as well as functions of stopping rain water from flowing backward and draining out rain water smoothly.

6 Claims, 48 Drawing Sheets

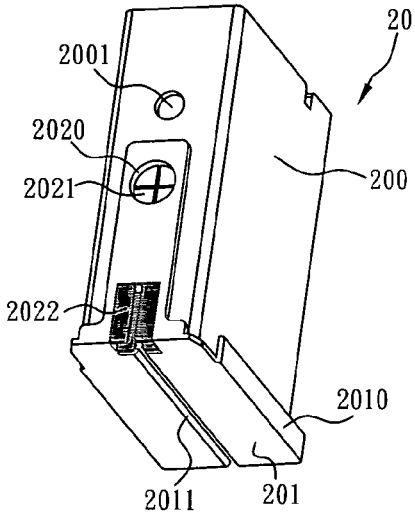
FIG.11-a
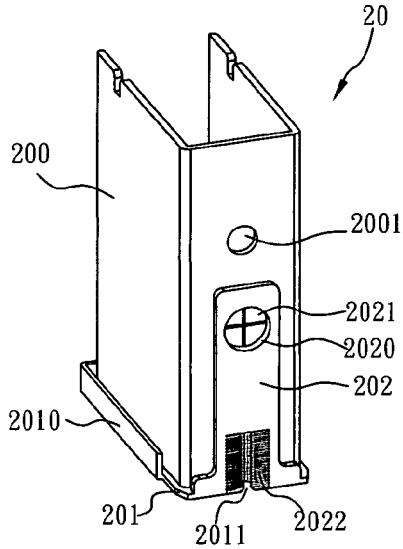
FIG.11-b
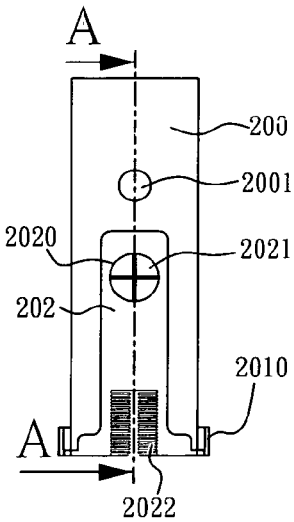
FIG.11-c
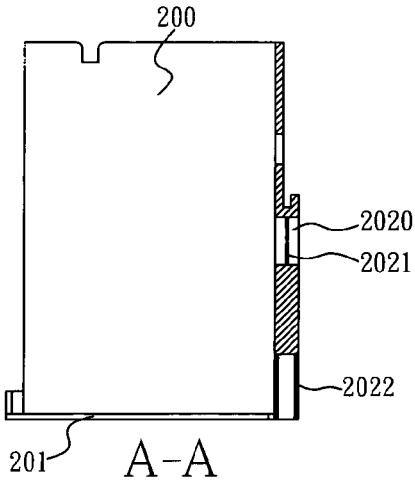
FIG.11-d
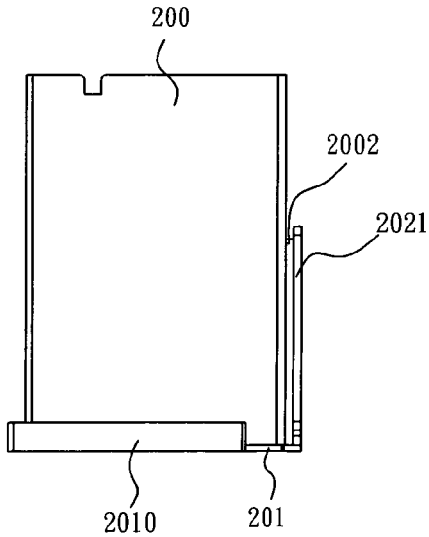
FIG.11-e

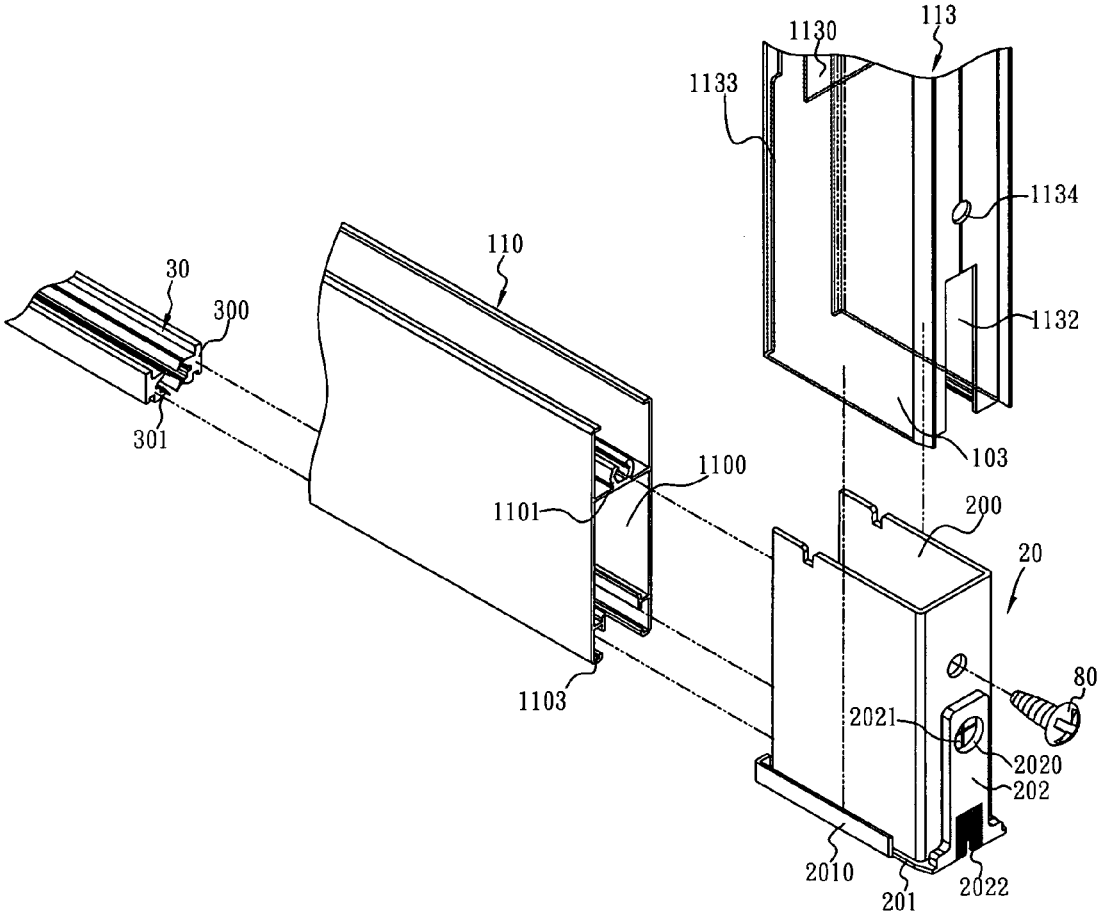
FIG.12-b
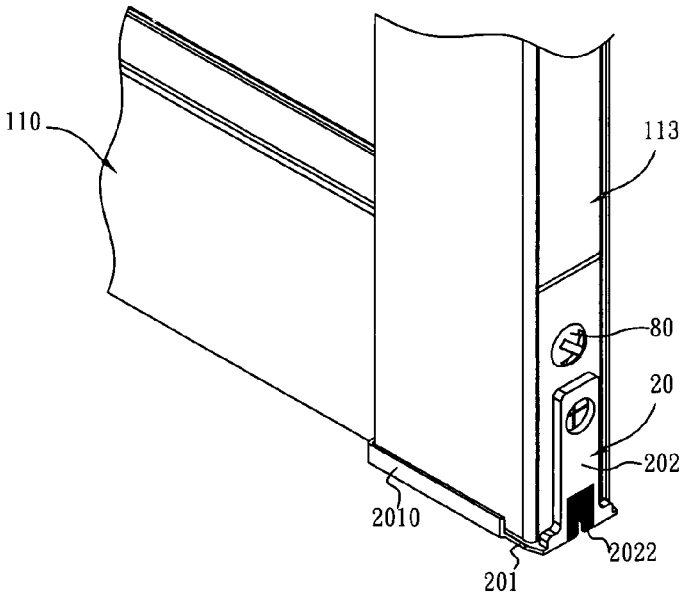
FIG.12-a

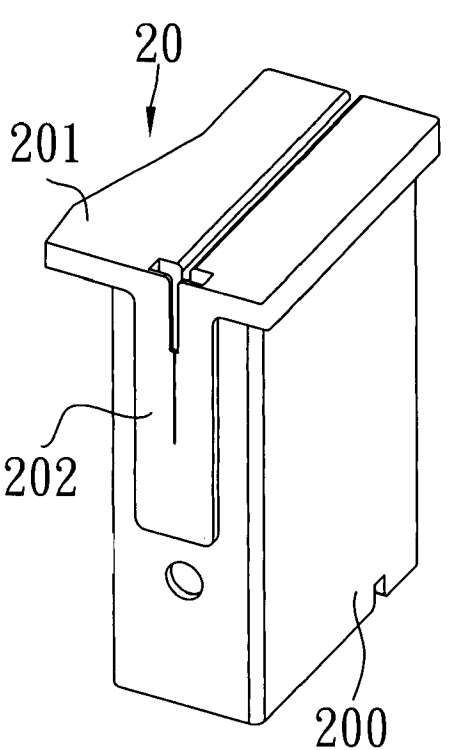
FIG.14-c
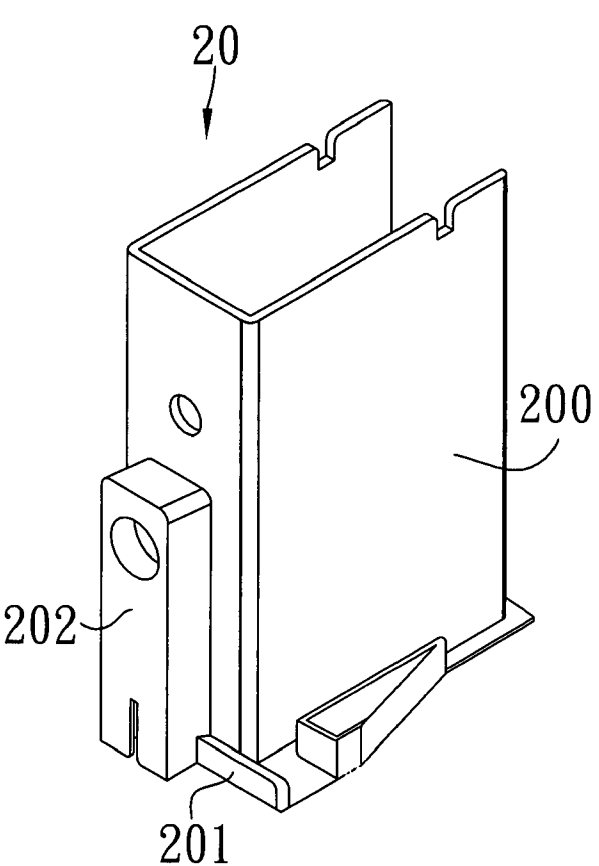
FIG.14-b
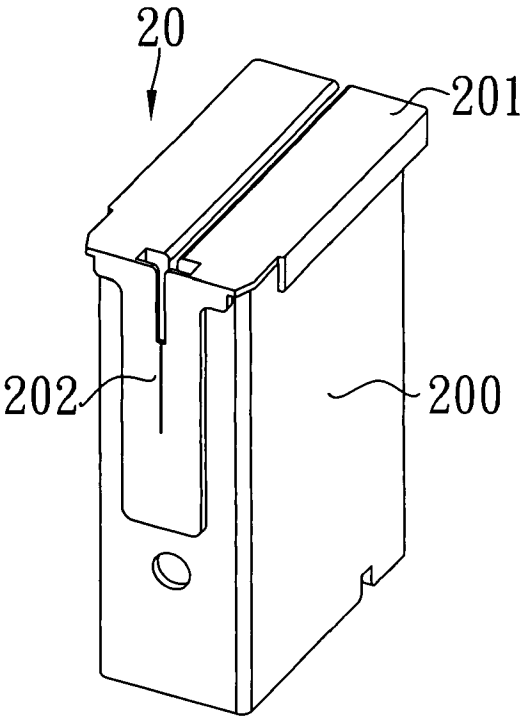
FIG.14-a

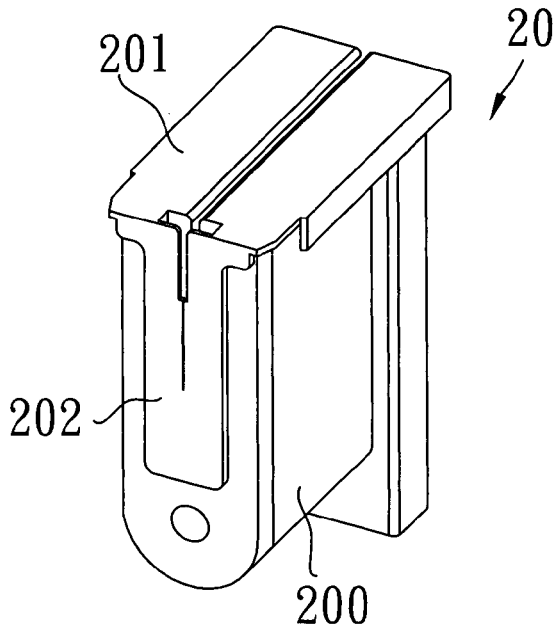
FIG.15-a
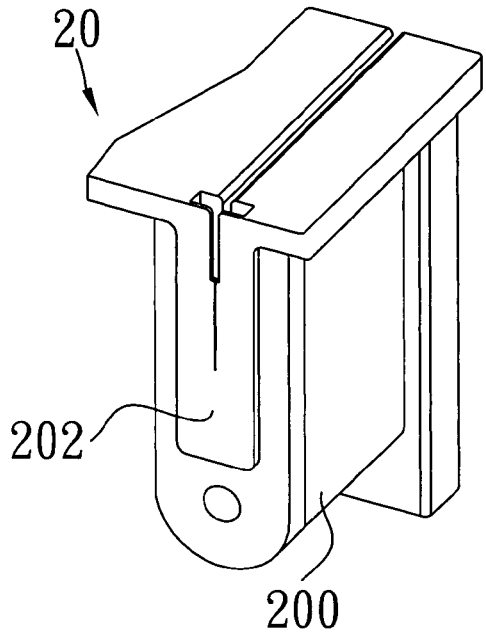
FIG.15-b
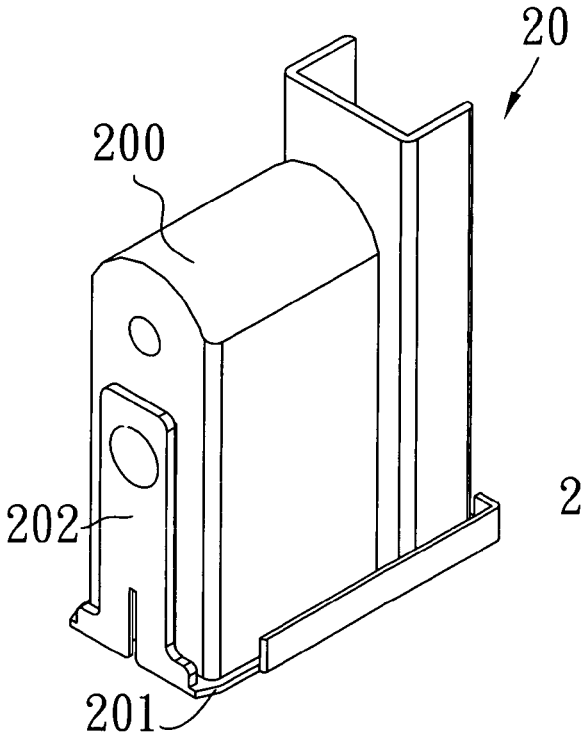
FIG.15-c
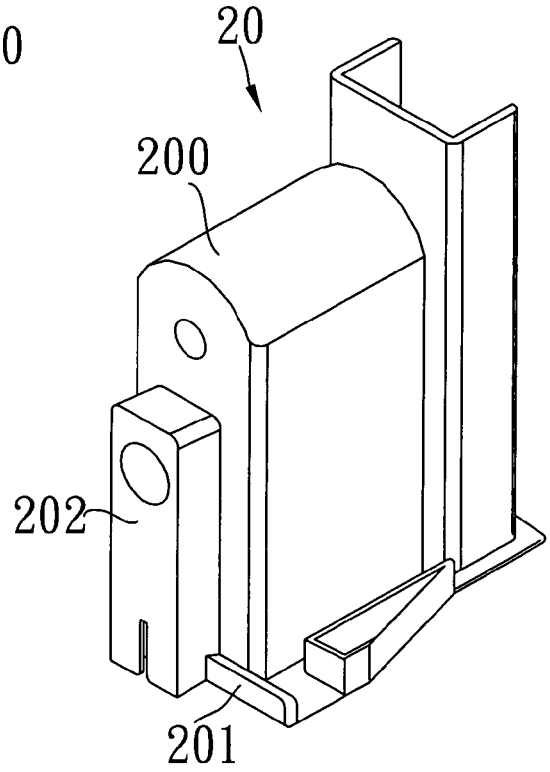
FIG.15-d

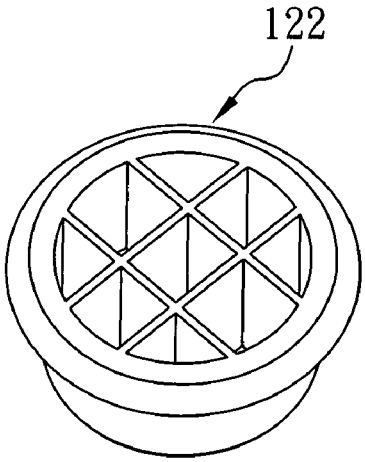
FIG.33-a
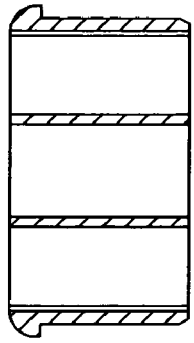
FIG.33-b
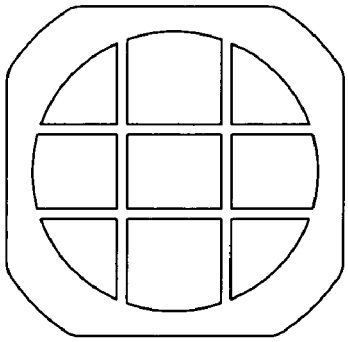
FIG.33-c
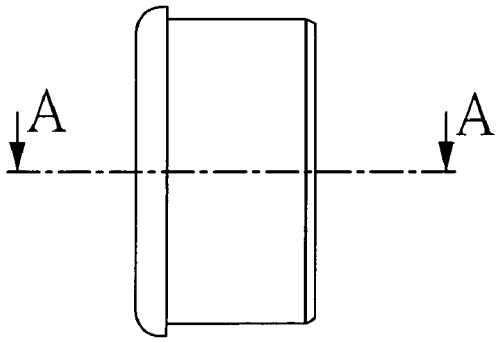
FIG.33-d

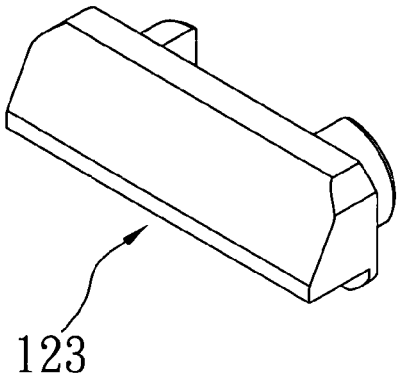
FIG.34-a
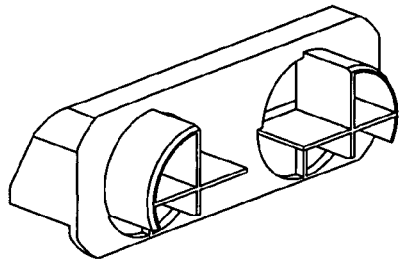
FIG.34-b
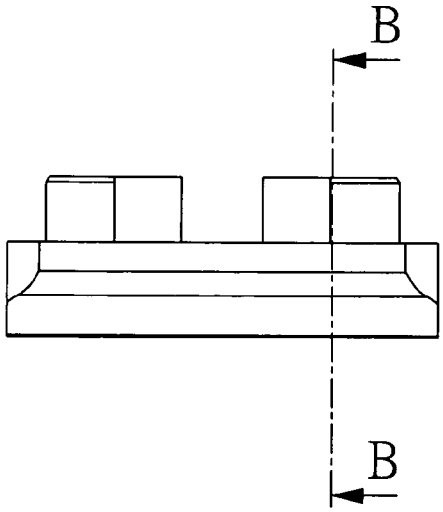
FIG.34-d
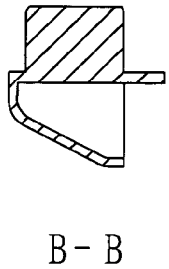
FIG.34-c
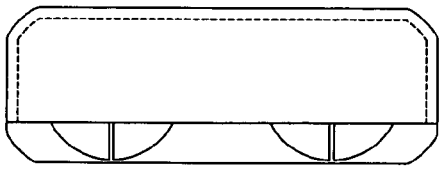
FIG.34-e
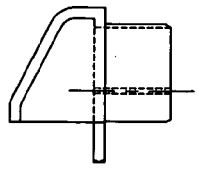
FIG.34-f

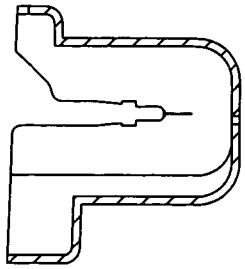
FIG.35-c
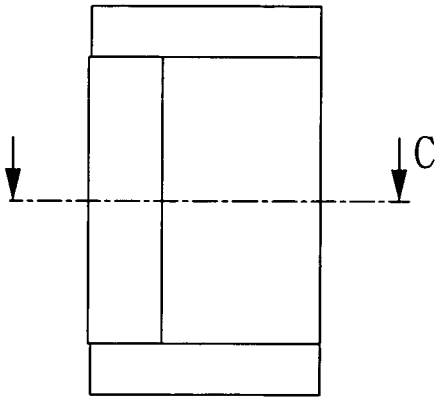
FIG.35-d
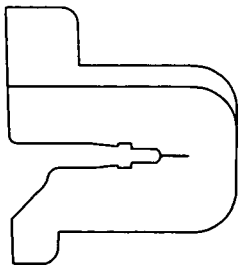
FIG.35-e
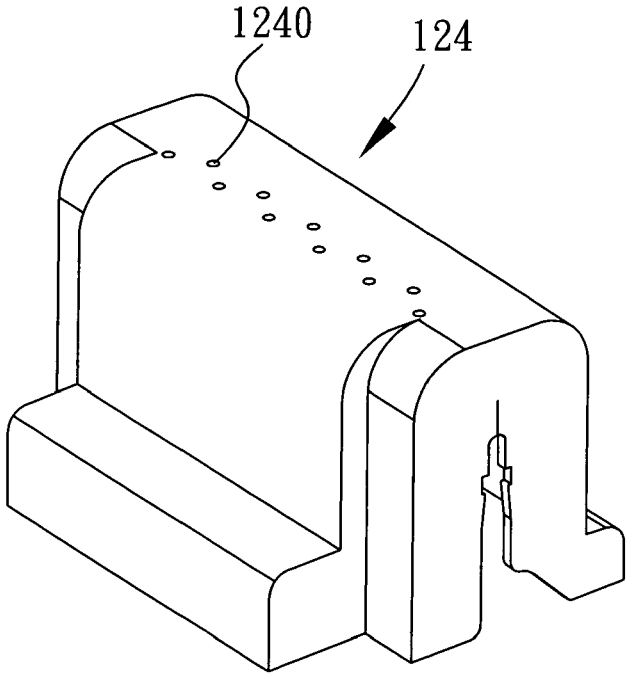
FIG.35-a
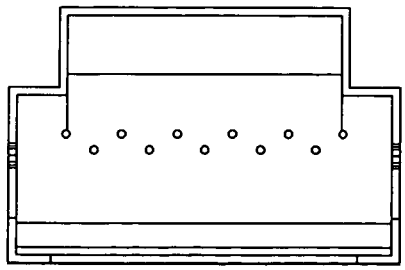
FIG.35-b

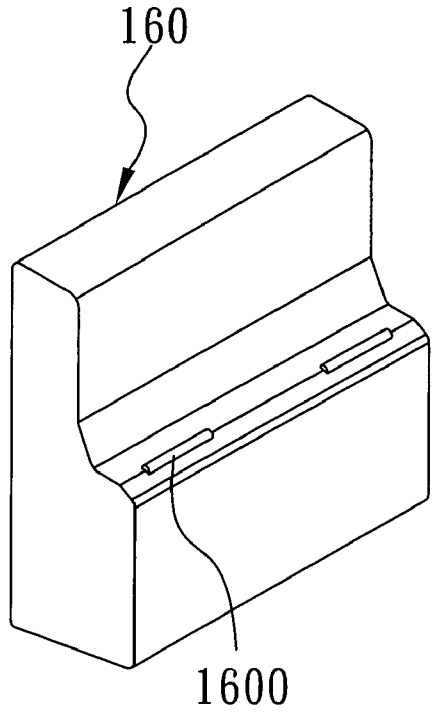
FIG.36-a
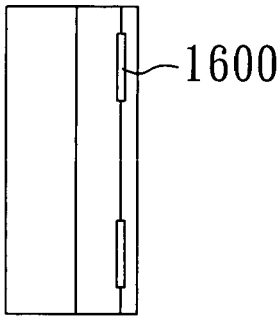
FIG.36-d
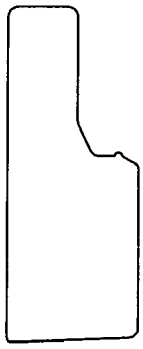
FIG.36-e
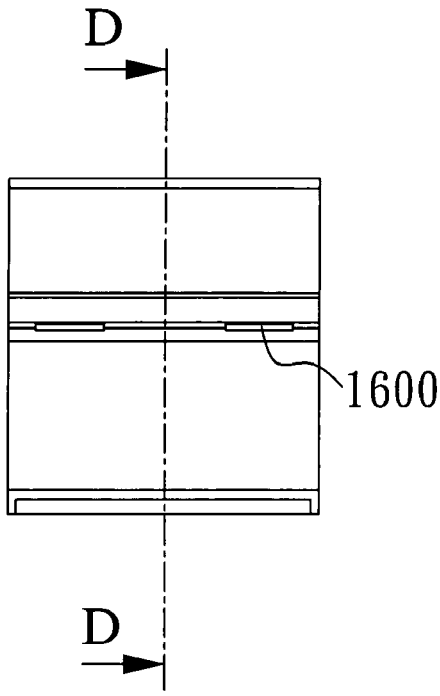
FIG.36-c
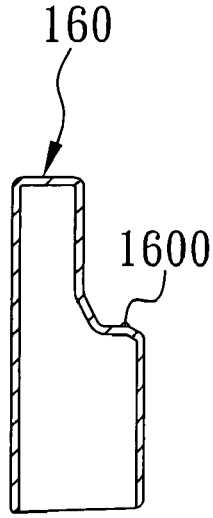
D - D
FIG.36-b A'
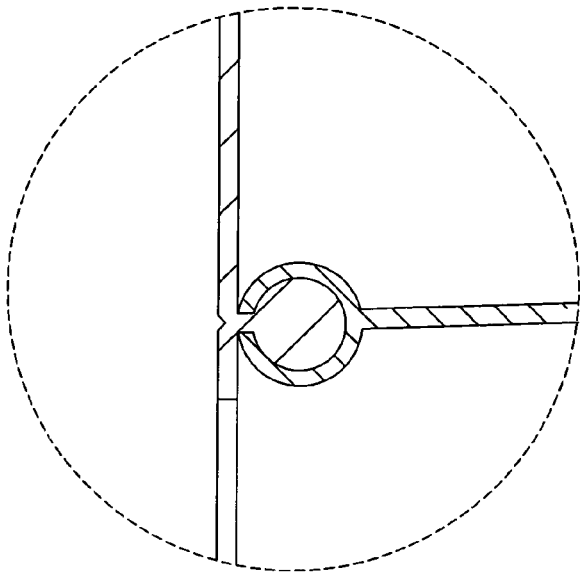
FIG.38-a
A'
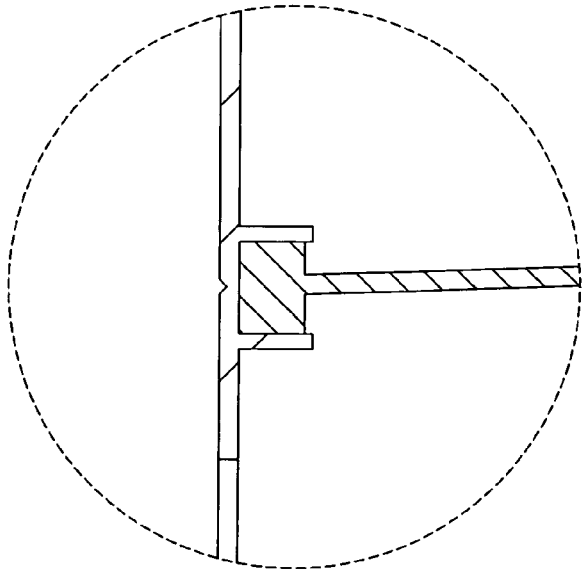
FIG.38-b

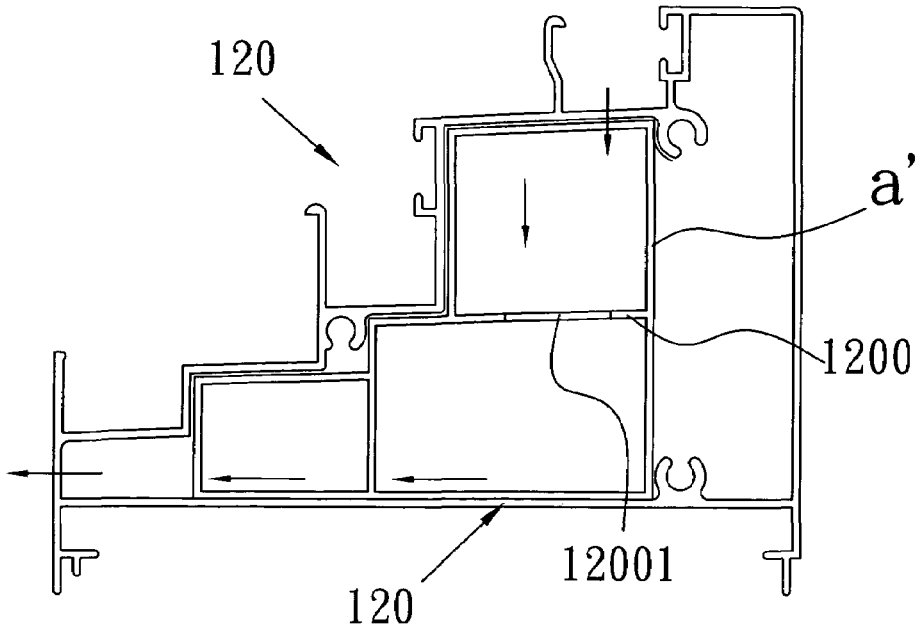
FIG.39-b
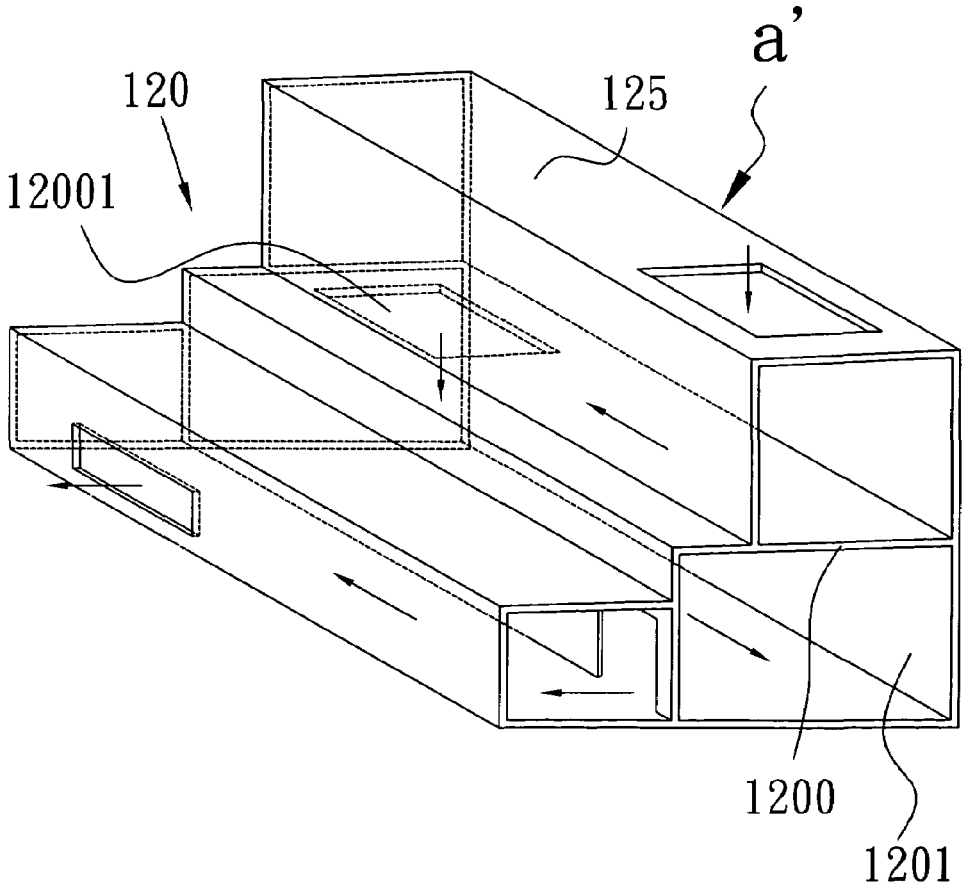
FIG.39-a

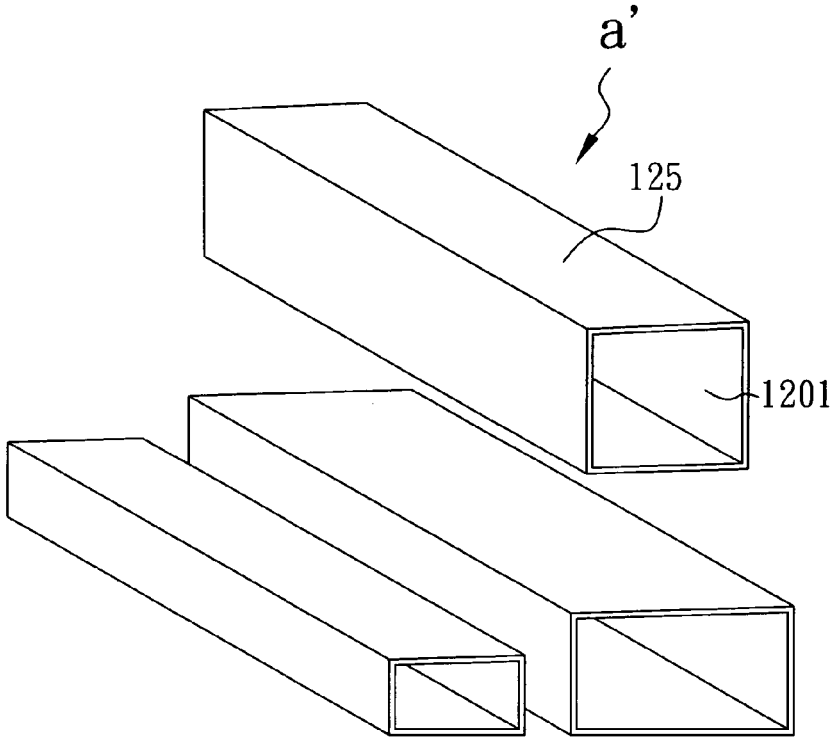
FIG.40-a
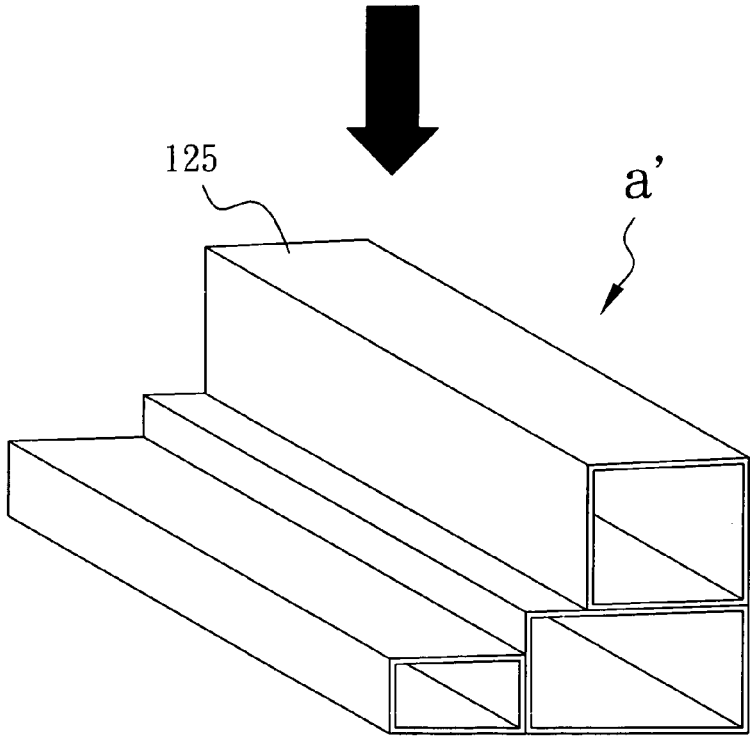
FIG.40-b

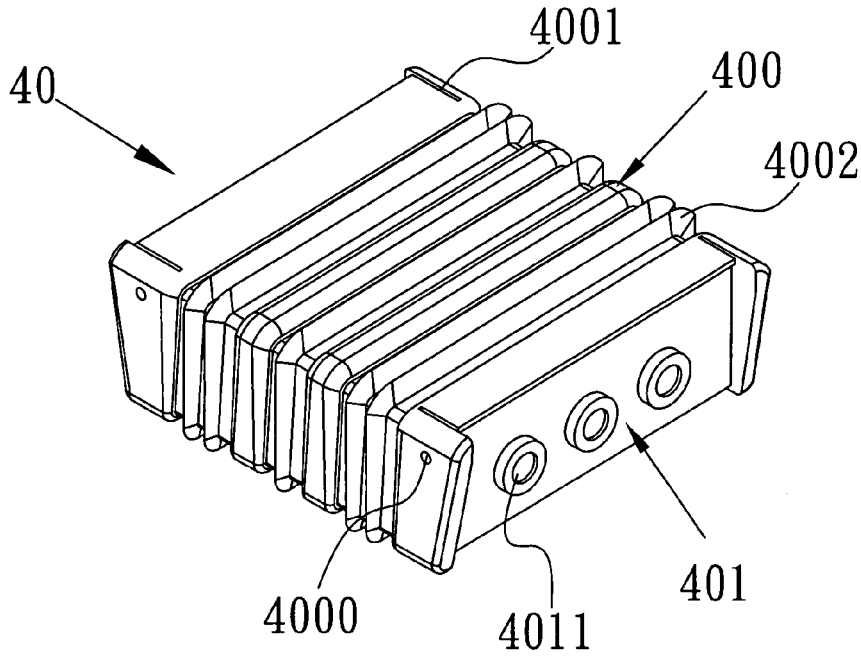
FIG. 41-b
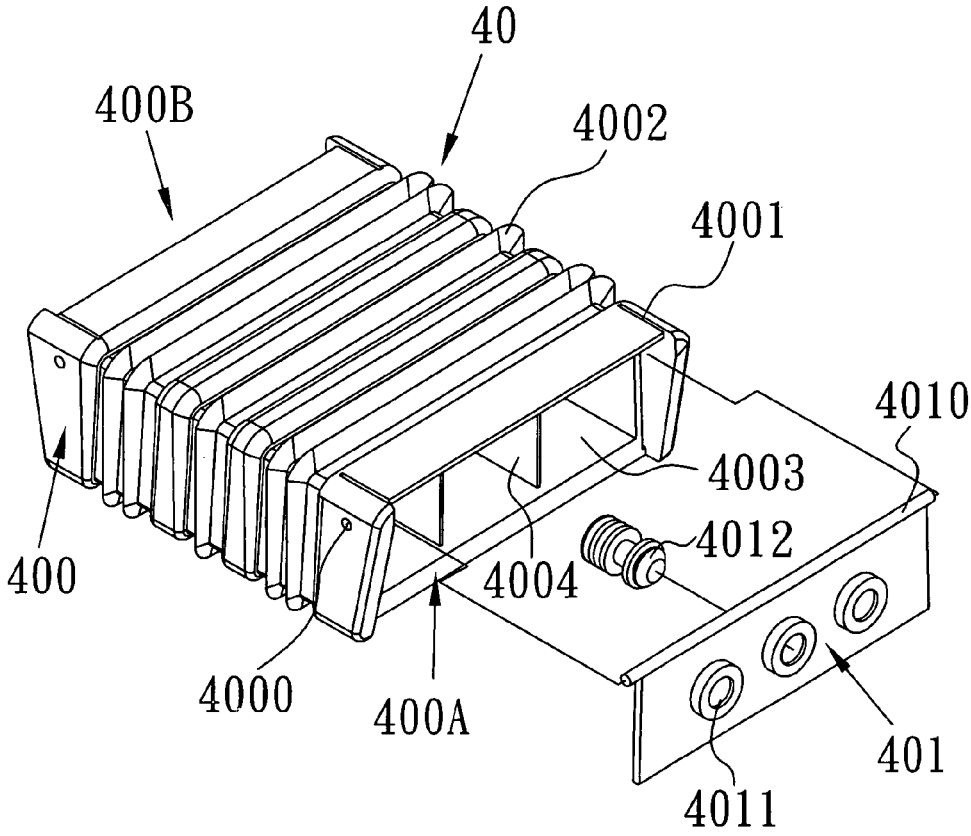
FIG. 41-a

FIG. 42-b
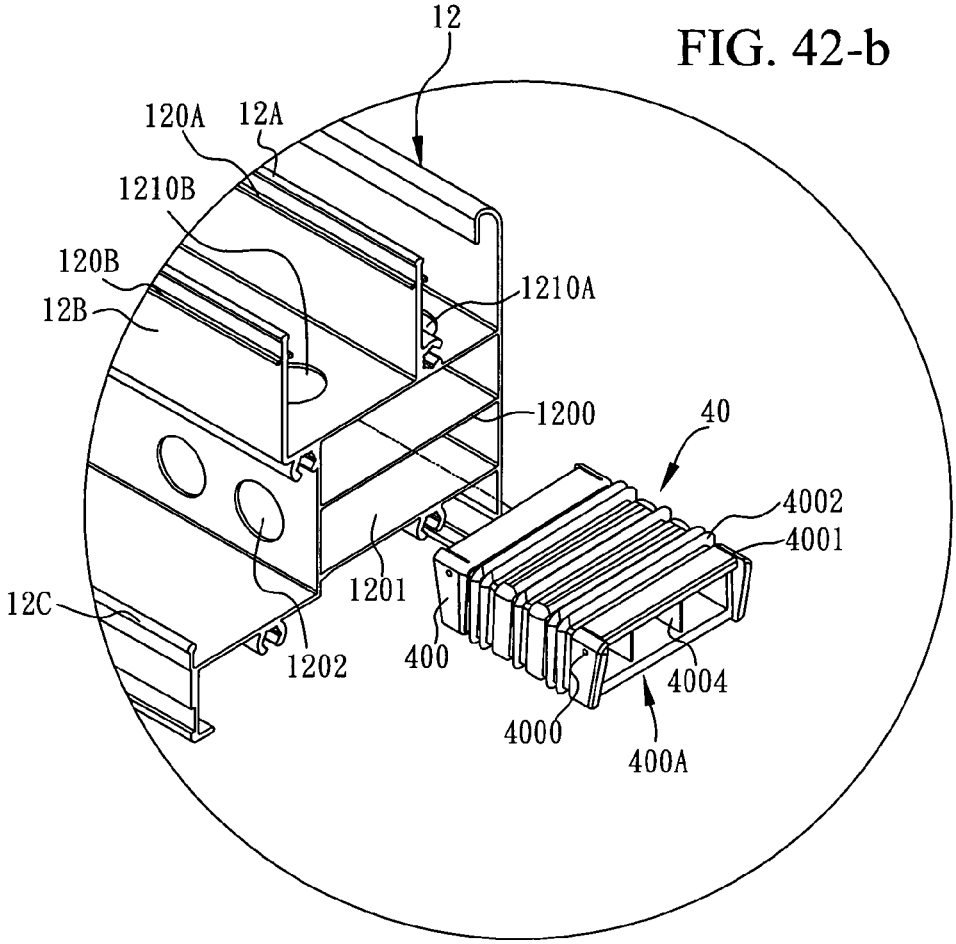
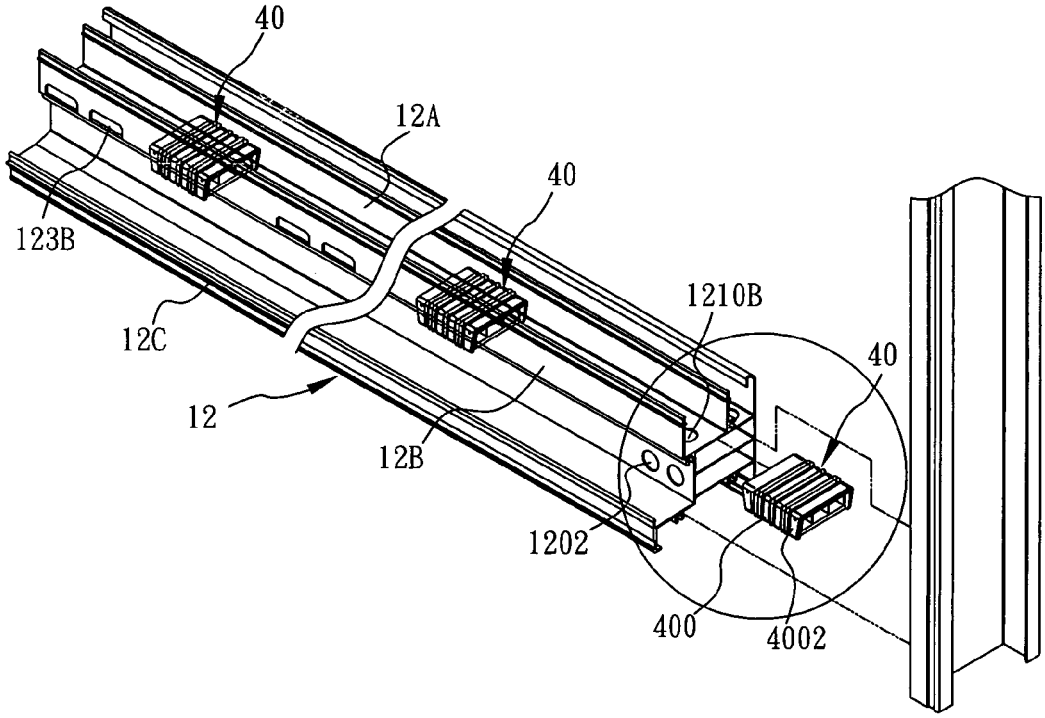
FIG. 42-a

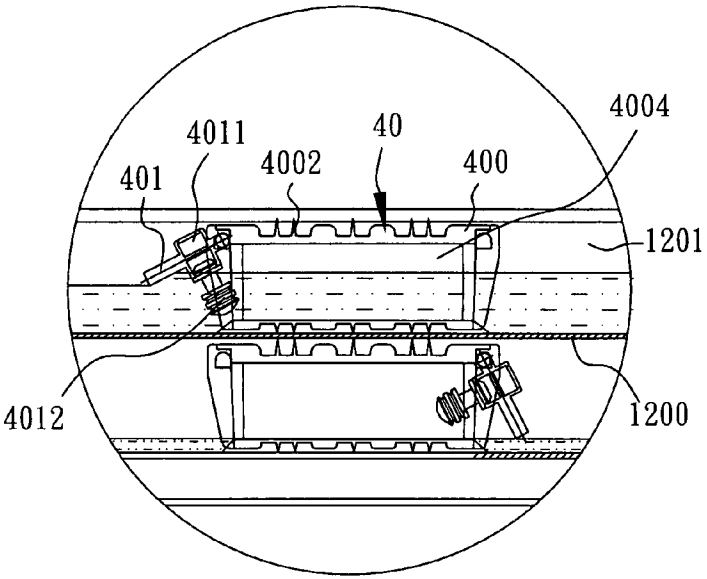
FIG.44-c
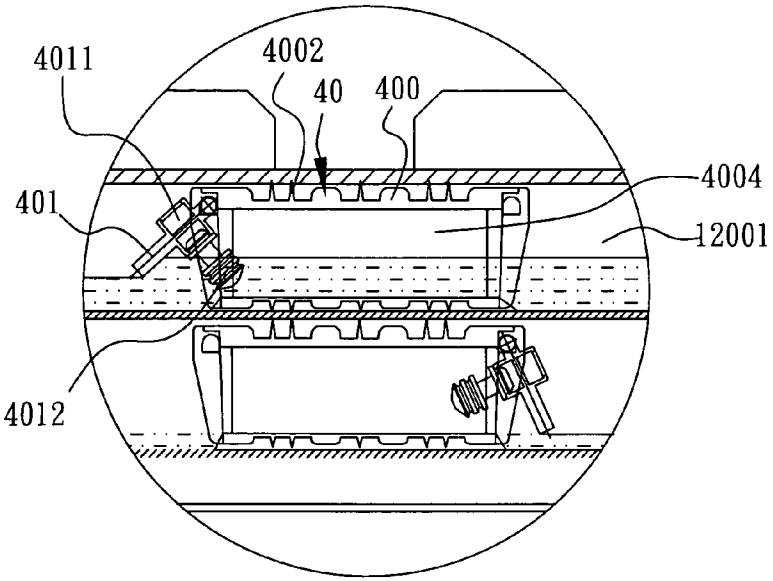
FIG.44-b
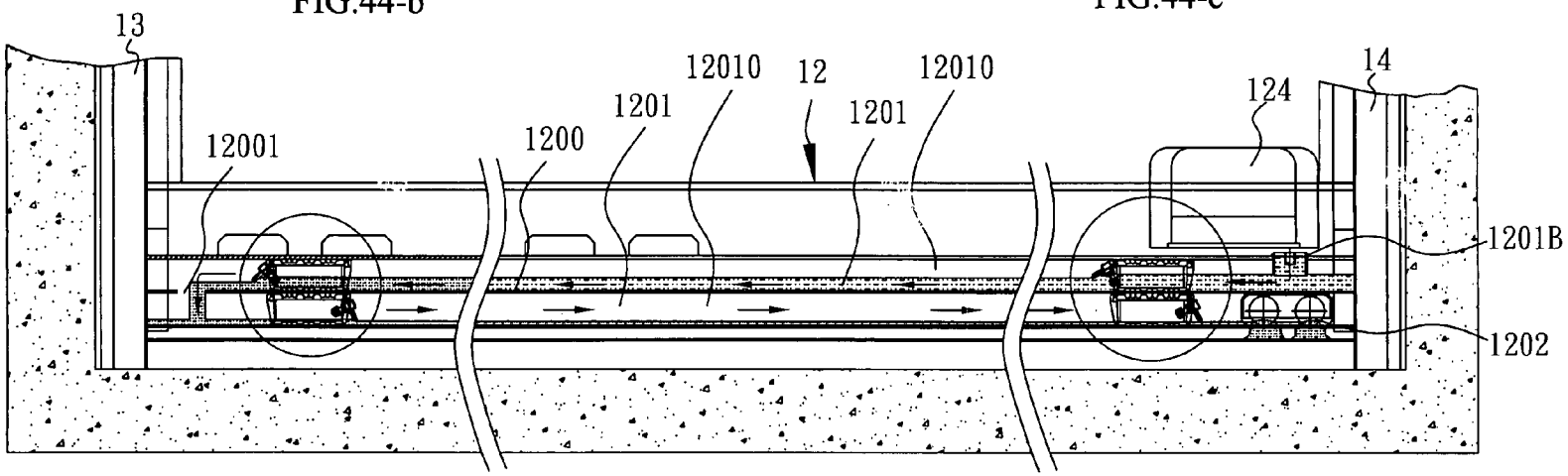
FIG.44-a

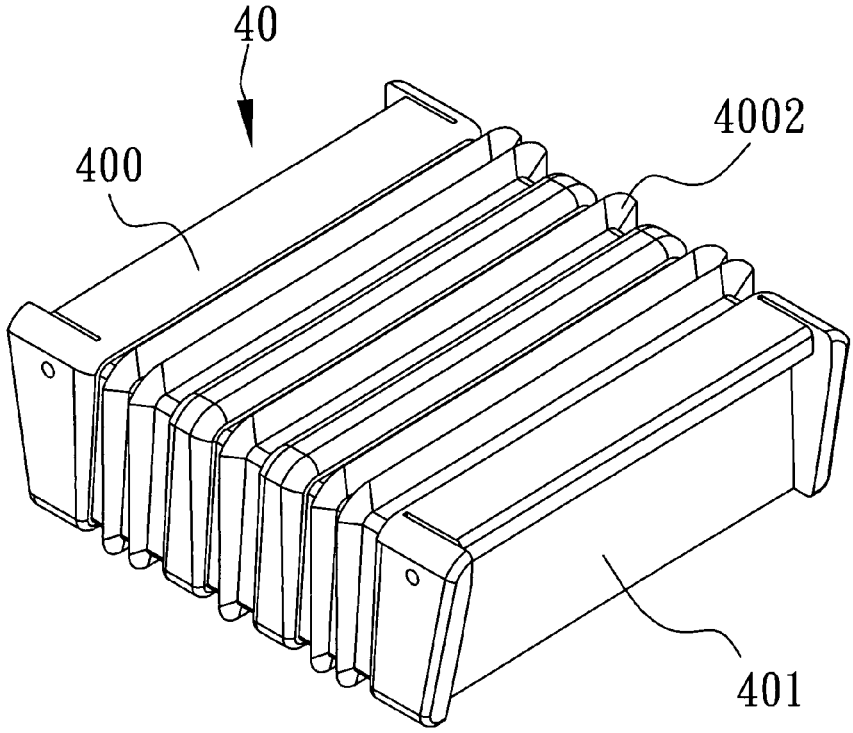
FIG. 45-a
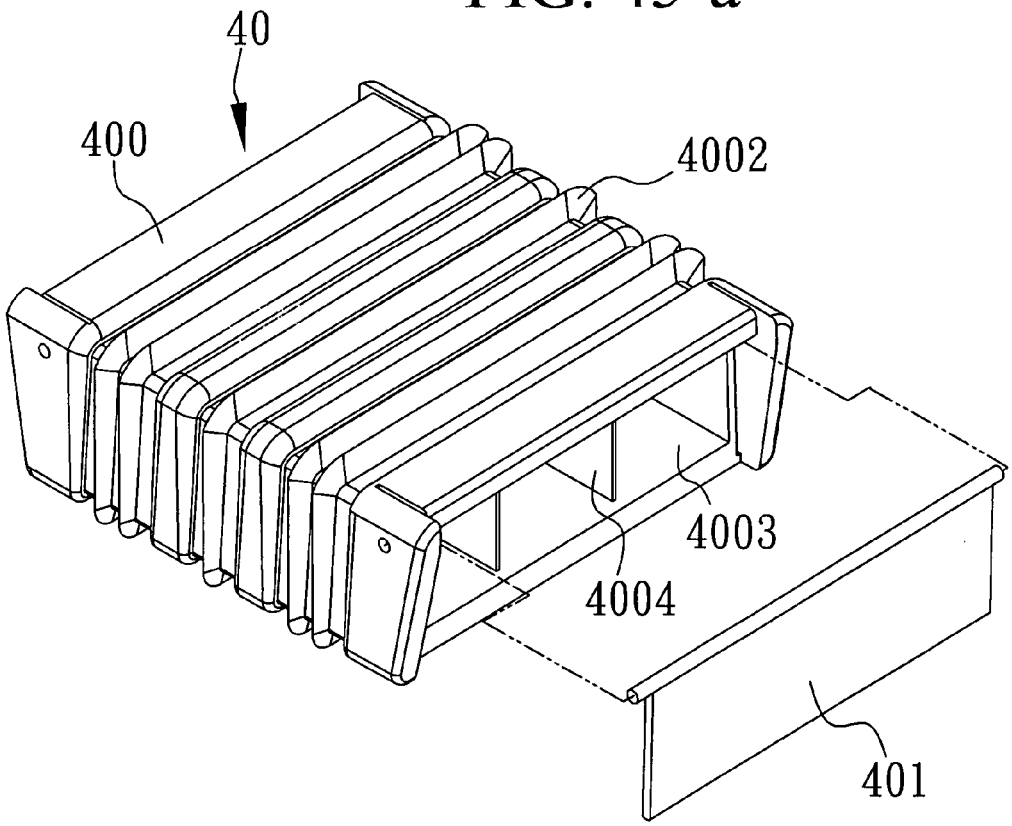
FIG. 45-b

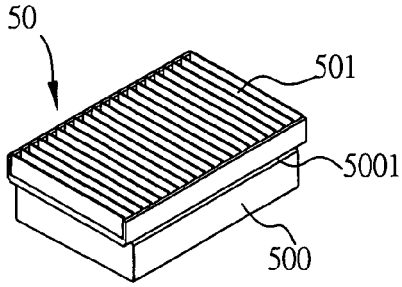
FIG. 46-a
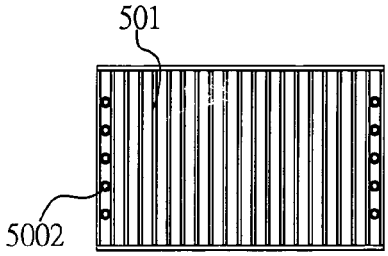
FIG. 46-b
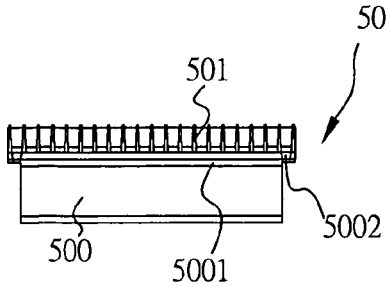
FIG. 46-c
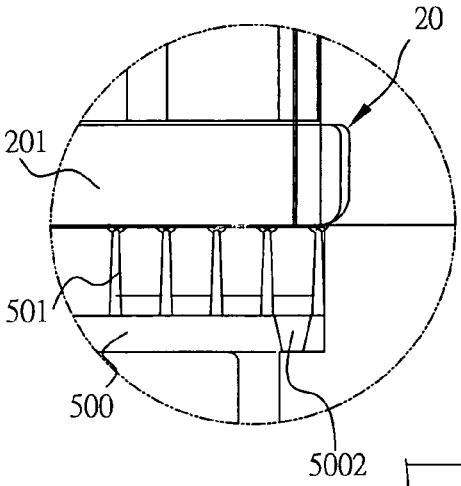
FIG. 47-d
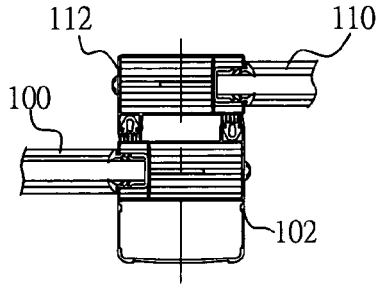
FIG. 47-b
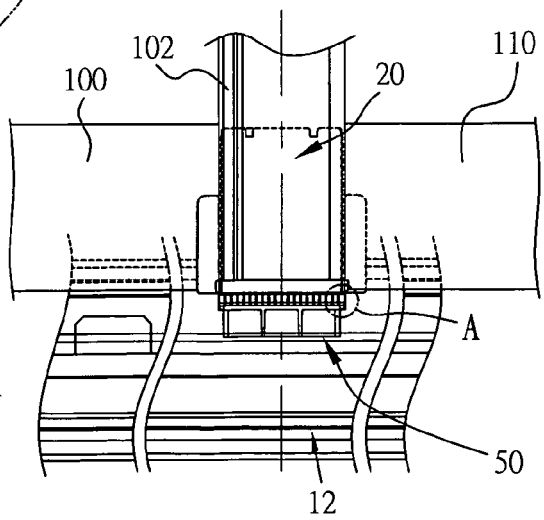
FIG. 47-a
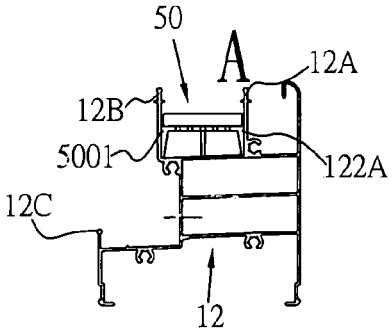
FIG. 47-c

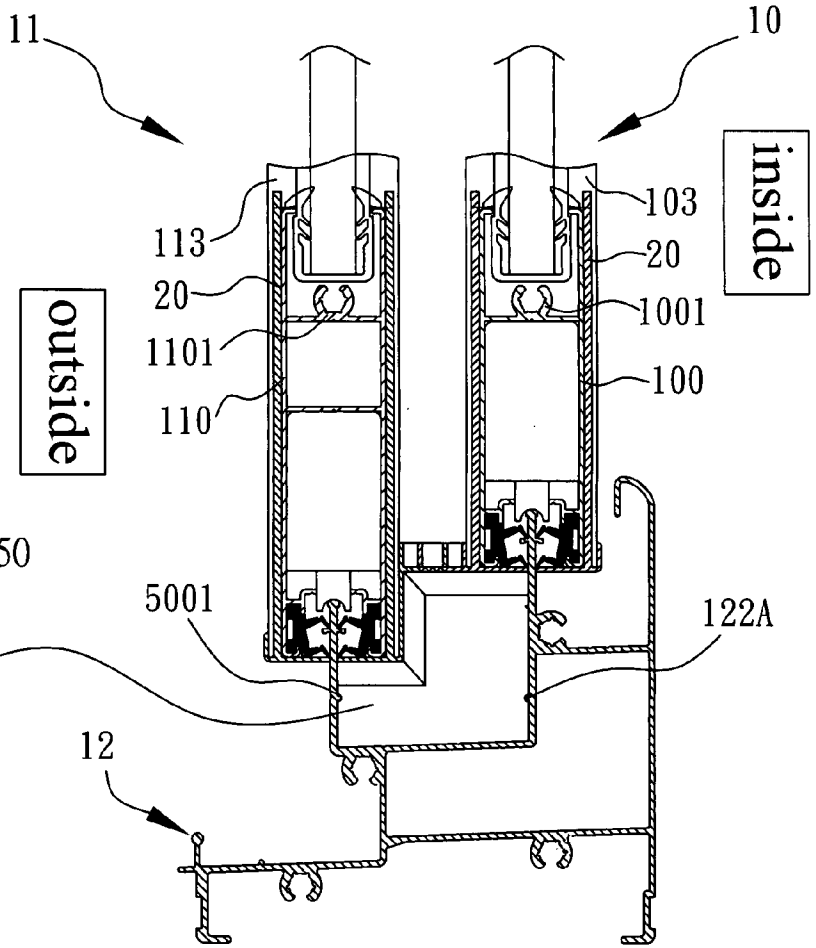
FIG. 54-a
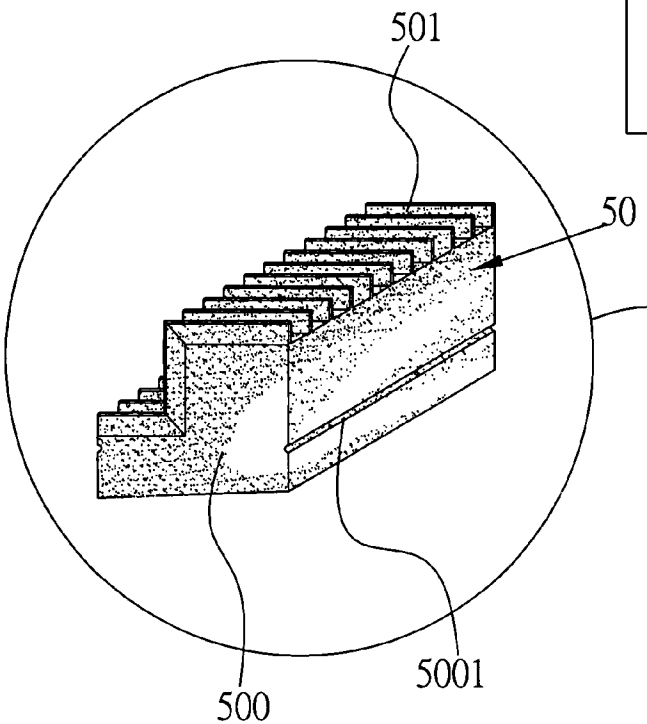
FIG. 54-b

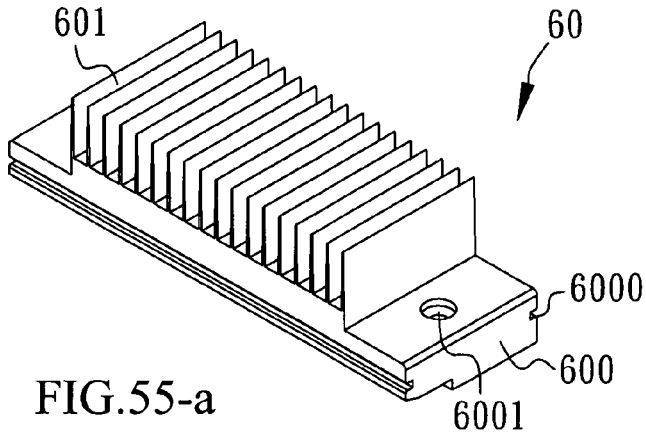
FIG.55-a
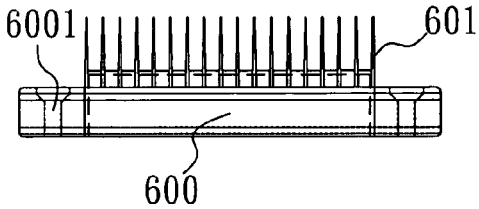
FIG.55-b
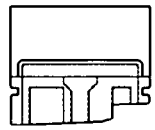
FIG.55-c
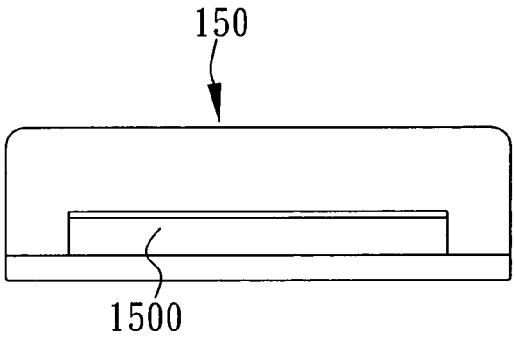
FIG.56-b
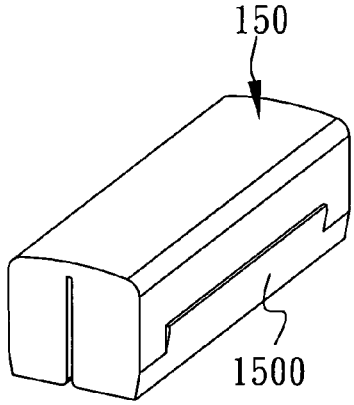
FIG.56-a
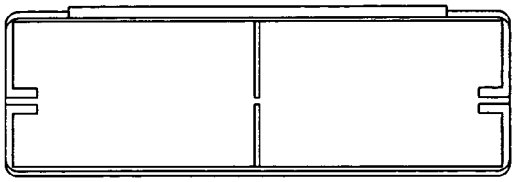
FIG.56-c
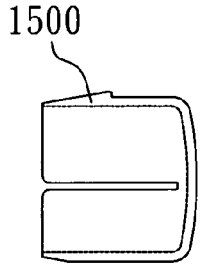
FIG.56-d

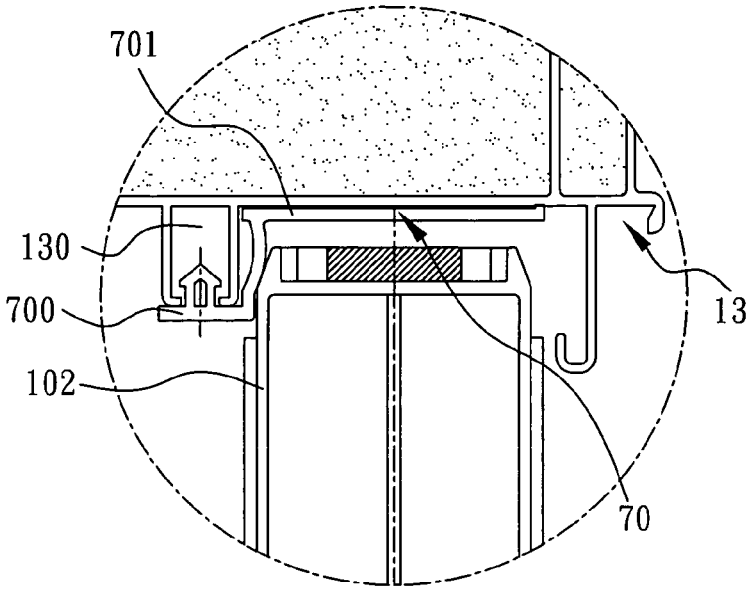
FIG.60-a
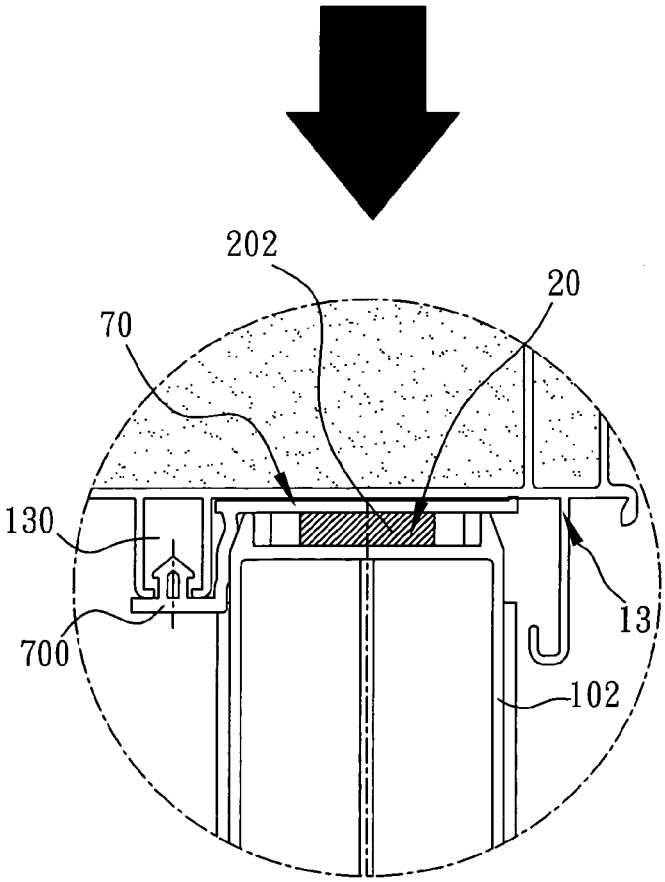
FIG.60-b

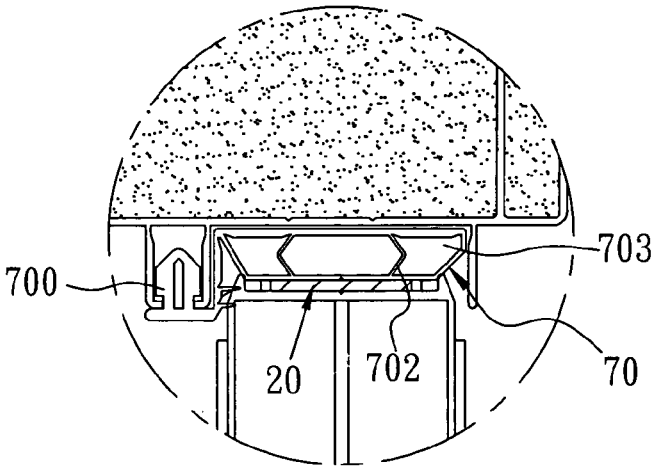
FIG.61-a
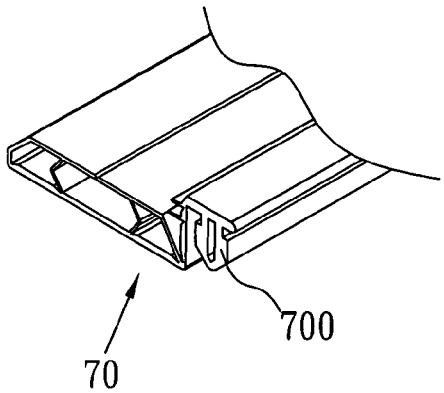
FIG.61-c
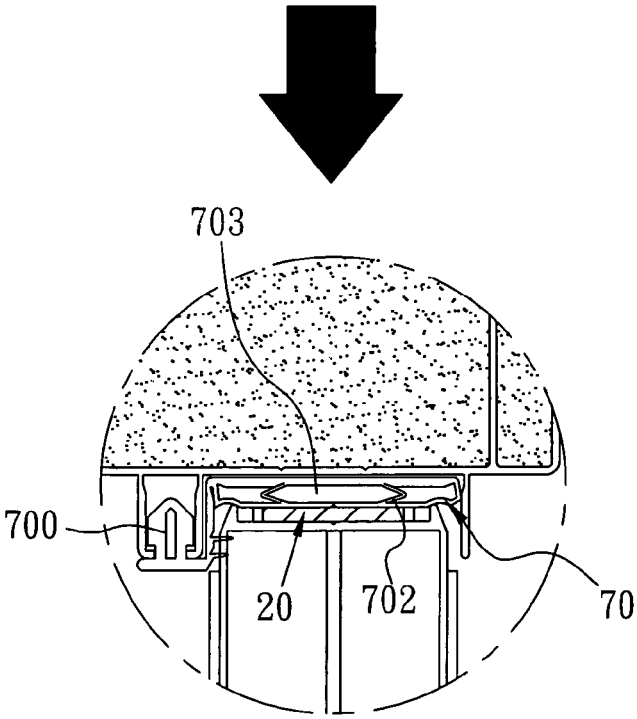
FIG.61-b
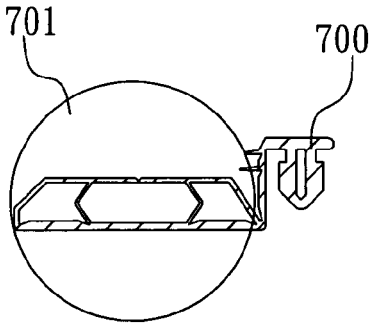
FIG.61-d

WIND AND RAIN PREVENTING DEVICE FOR ALUMINUM DOORS AND WINDOWS

BACKGROUND OF THE INVENTION

1. Field of the Invention

This invention relates to a wind and rain preventing device for aluminum doors and windows, particularly to one able to tightly combine a lower frame, an inner window and an outer window together to stop strong wind and heavy rain from getting in a room and also able to quickly drain rain water out of the window grooves and having good effects of water and air tightness and sound insulation.

2. Description of the Prior Art

A conventional high-and-low stepped aluminum window 1*a*, as shown in FIGS. 1 and 2, includes a lower frame 10*a* has its topside surface formed with a high and a low step so that rain water dropping on the lower frame 10*a* can flow to the outside of a room. The high and the low step of the lower frame 10*a* are respectively provided with an inner window slide rail 100*a* and an outer window slide rail 101*a* respectively fitted thereon with an inner window 11*a* and an outer window 12*a*. The inner and the outer window slide rail 100*a*, 101*a* are respectively bored with a draining hole 102*a*, 103*a* and respectively have one side formed with an inner window groove 104*a* and an outer window groove 105*a* for draining water away. Thus, water gathered in the inner and the outer window grooves 104*a*, 105*a* can be drained away to the outside of a room through the draining holes 102*a*, 103*a* of the inner and the outer window rail 100*a*, 101*a*. In addition, the inner window 11*a* and the outer window 12*a* are respectively formed with a same window structure made of two symmetrical horizontal window frames 110*a*, 120*a* and two symmetrical vertical window frames 11*a*, 121*a*.

The horizontal window frames 110*a*, 120*a* have their interiors respectively formed with an accommodating space 112*a*, 122*a* respectively fitted therein with a roller 113*a*, 123*a*. Thus, the inner and the outer window 11*a*, 12*a* can be slidably moved on the inner and the outer window slide rail 100*a*, 101*a* by means of the roller 113*a*, 123*a* for opening and closing. The accommodating space 112*a*, 122*a* have their lower edges abutting the opposite sides of the inner and the outer window rail 100*a*, 101*a* respectively formed with two opposite and symmetrical engage grooves 114*a*, 124*a* having their inner sides respectively inserted with a water-proof block 115*a*, 125*a* composed of an engage member 1150*a*, 1250*a* and a water-proof member 1151*a*, 1251*a*. Although the water-preventing blocks 115*a*, 125*a* are provided for hindering rain water and strong wind from getting in a room through the bottoms of the inner and the outer window 11*a*, 12*a*, yet the water-preventing members 1151*a*, 1251*a* of the water-proof blocks 115*a*, 125*a* are not strong enough to block strong wind and heavy rain. When strong wind together with pouring rain blows towards the water-proof members 1151*a*, 1251*a* of the inner and the outer window 11*a*, 12*a*, the water-proof members 1151*a*, 1251*a* are likely to be blown and moved to cause gaps between the water-prevent members 1151*a*, 1251*a* and the inner and the outer window slide rails 110*a*, 101*a*, rendering strong wind and rain able to invade in a room through the gaps.

Referring to FIGS. 3 and 4, although the inner and the outer window 11*a*, 12*a* of the conventional high-and-low stepped aluminum window 1*a* is provided with water-proof blocks 115*a*, 125*a* engaged in the engage grooves 114*a*, 124*a* in the lower inner side of the horizontal window frames 110*a*, 120*a*, yet such water-preventing blocks 115*a*, 125*a* are too simple in structure to block strong wind and pouring rain. Further, after the horizontal window frames 110*a*, 120*a* and the vertical window frames 111*a*, 121*a* are combined together, their joint portions may form gaps contacting with the lower frame 10*a*; therefore, rain water is easy to get in the lower frame 10*a* through the joint gaps and gathered therein, as indicated by block arrows shown in FIG. 3. Furthermore, the rain water gathered in the lower frame 10*a* is likely to be blown by strong wind to splash about or directly get in a room through the draining holes 102*a*, 103*a* of the inner and the outer window slide rails 100*a*, 101*a*. A waterproof block 13*a* composed of a block member 130*a* and a sheet-shaped member 131*a* can be fitted at central portion of the inner side of the outer window groove 105*a*. Thus, when the inner and the outer window 11*a*, 12*a* are in a closed condition, the gaps formed between the lower overlapping portion of the two windows 11*a*, 12*a* and the inner and the outer window slide rail 100*a*, 101*a* can be blocked and covered up by the sheet-shaped member 131*a* of the water-proof block 13*a* to prevent rain water from getting in a room, and the rain water in the outer window groove 105*a* can be stopped from flowing backward.

However, the block member 130*a* of the water-proof block 13*a* has no draining means, unable to carry out water draining; therefore, when rain water is blocked by the sheet-shaped member 131*a* and drops on the block member 130*a*, it will be gathered in the gaps of the sheet-shaped members 131*a* and impossible to be drained out quickly. Thus, when strong wind together with rain blows violently, rainwater will splash to overflow the lower frame 10*a* and get in a room.

A conventional flush-stepped window 2*a*, as shown in FIGS. 5 to 8, includes a lower frame 20*a* having its topside surface provided with an inner and an outer window slide rail 200*a*, 201*a* respectively assembled thereon with an inner window 21*a* and an outer window 22*a*. The conventional flush-stepped windows 2*a* has the same structure and the same defects as those of the conventional high-and-low stepped window 1*a*, although the conventional flush-stepped window 2*a* can be assembled and disassembled comparatively easily.

As can be understood from the above description, either the conventional high-and-low stepped windows and flat-stepped windows are unable to mutually combine the lower frame together with the inner window and the outer window tightly, likely to form gaps at the joint portions and other badly designed portions, As a result, strong wind and rain water are easy to get in a room through these gaps.

SUMMARY OF THE INVENTION

The objective of the invention is to offer a wind and rain preventing device for aluminum doors and windows, able to effectively prevent strong wind and rain water from getting in a room, enabling a lower frame and an inner window together with an outer window to be mutually combined tightly, and having excellent functions of air and resistance to wind pressure as well as good effect of water draining.

The wind and rain preventing device for aluminum doors and windows of this invention includes a window structure made of an inner window, an outer window, a lower frame, two side frames and an upper frame. The wind and rain-preventing device is provided with covering-and-clogging casings, water-preventing elongate members, a lower wind and rain-stopping block, draining valves, an upper wind and rain-stopping block, and collision-preventing and airtight elongate members. The covering-and-clogging casing are respectively fitted at the joint corners of the peripheral frames of the inner and the outer windows, able to prevent rain water from getting in the frames of the inner and the outer windows.

The water-proof elongate members are respectively fixed in the upper and the lower inner sides of the inner window and the outer window frames abutting the lower frame and the upper frame, able to block rain water. The lower wind-and-rain-stopping block is fixed on the lower frame and at the lower edge of the overlapping portion of the inner and the outer windows, able to stop rain water from splashing and leaking in a room. The draining valves are fitted in the interior of the lower frame, able to control the draining amount of rainwater and facilitate water draining. The upper wind-and-rain-stopping block is disposed on the upper frame and at the upper edge of the overlapping portions of the inner and the upper windows, able to block rainwater. The collision-preventing and airtight elongate members having functions of buffering and blocking rainwater are respectively secured on the two side frames at the locations abutting the inner and the outer windows.

BRIEF DESCRIPTION OF DRAWINGS

This invention will be better understood by referring to the accommodating drawings, wherein:

FIGS. 11-*a*, -*b*, -*c*, -*d*, -*e* are perspective, side and cross-sectional views of a covering-and-clogging casing in the present invention:

FIGS. 12-*a*, and -*b* are perspective views of the covering-and-clogging casing assembled with a vertical and a horizontal window frame in the present invention:

FIGS. 14-*a*, -*b* and -*c* are perspective views of different portions of the covering-and-clogging casing in the present invention:

FIGS. 15-*a*, -*b*, -*c* and -*d* are perspective views of different-typed covering-and-clogging casings in the present invention:

FIGS. 33-*a*, -*b*, -*c* and -*d* are perspective, cross-sectional and side views of a draining hole plug in the present invention:

FIGS. 34-*a*, -*b*, -*c*, -*d*, -*e* and -*f* are perspective, cross-sectional and side views of a water outlet plug in the present invention:

FIGS. 35-*a*, -*b*, -*c*, -*d* and -*e* are perspective, upper, cross-sectional and side views of a wind-blocking cover in the present invention:

FIGS. 36-*a*, -*b*, -*c*, -*d* and -*e* are perspective, upper, cross-sectional and side views of a window screen-blocking member in the present invention:

FIGS. 38-*a*, -*b* are partial front views of the part A' indicated in FIG. 37:

FIGS. 39-*a* and -*b* are perspective and side-sectional views of a first preferred embodiment of an inner draining space in the present invention:

FIGS. 40-*a* and -*b* are exploded and perspective views of a second preferred embodiment of an inner draining space in the present invention:

FIGS. 41-*a* and -*b* are exploded and perspective views of a draining valve in the present invention:

FIGS. 42-*a* and -*b* are perspective and magnified views of the draining valves fitted in the inner draining space of the lower frame in the present invention:

FIGS. 44-*a*, -*b* and -*c*, are cross-sectional and magnified views of a first preferred embodiment of the draining valves in the present invention:

FIGS. 45-*a* and -*b* are perspective and exploded views of a first preferred embodiment of FIG. 41:

FIGS. 46-*a*, -*b* and -*c* are perspective, upper and side views of a lower wind-and-rain-stopping block in the present invention:

FIGS. 47-*a*, -*b*, -*c* and -*d* are front, upper, side and magnified views of the lower wind-and-rain-stopping block shown in FIG. 46 in an assembling condition:

FIGS. 54-*a* and -*b* are cross-sectional and magnified views of a different height stepped lower wind-and-rain-stopping block in an assembling condition in the present invention:

FIGS. 55-*a*, -*b* and -*c* are front and side views of an upper wind-and-rain-stopping block in the present invention:

FIGS. 56-*a*, -*b*, -*c* and -*d* are front, bottom and side views of a collision-blocking member in the present invention:

FIGS. 60-*a* and -*b* are upper views of a first preferred embodiment of the collision-preventing and airtight elongate member in an open and a closed condition indicated by the part A in FIG. 59: and FIGS. 61-*a*, -*b*, -*c* and -*d* are upper, perspective and cross-sectional views of a second preferred embodiment of the collision-preventing and airtight elongate member in an open and a closed condition indicated by the part A in FIG. 59.

DETAILED DESCRIPTION OF THE PREFERRED EMBODIMENT

Figure 1:
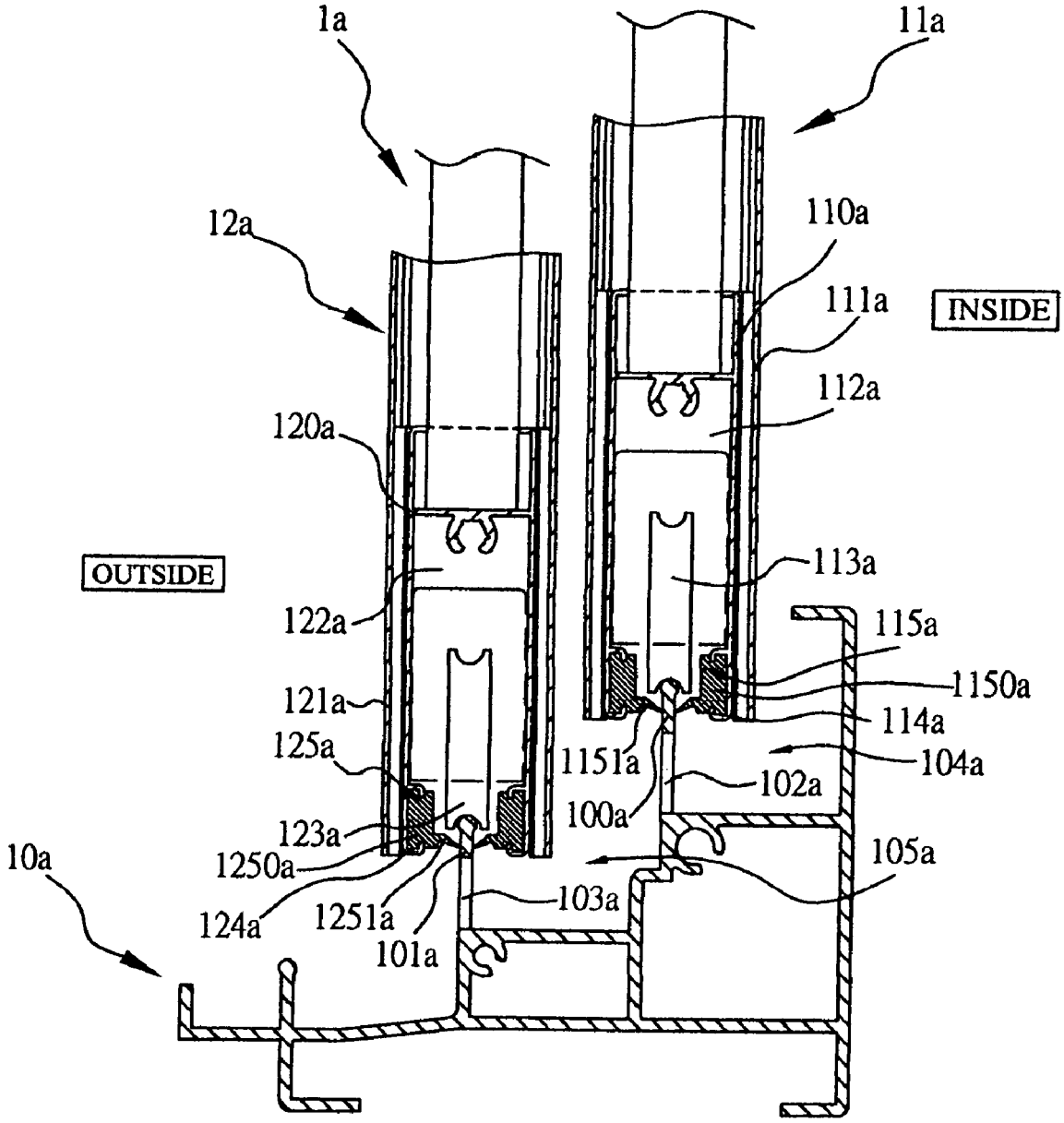
FIG. 1 PRIOR ART
FIG. 1 is a side cross-sectional view of a conventional high-and-low stepped aluminum window.
Figure 2:
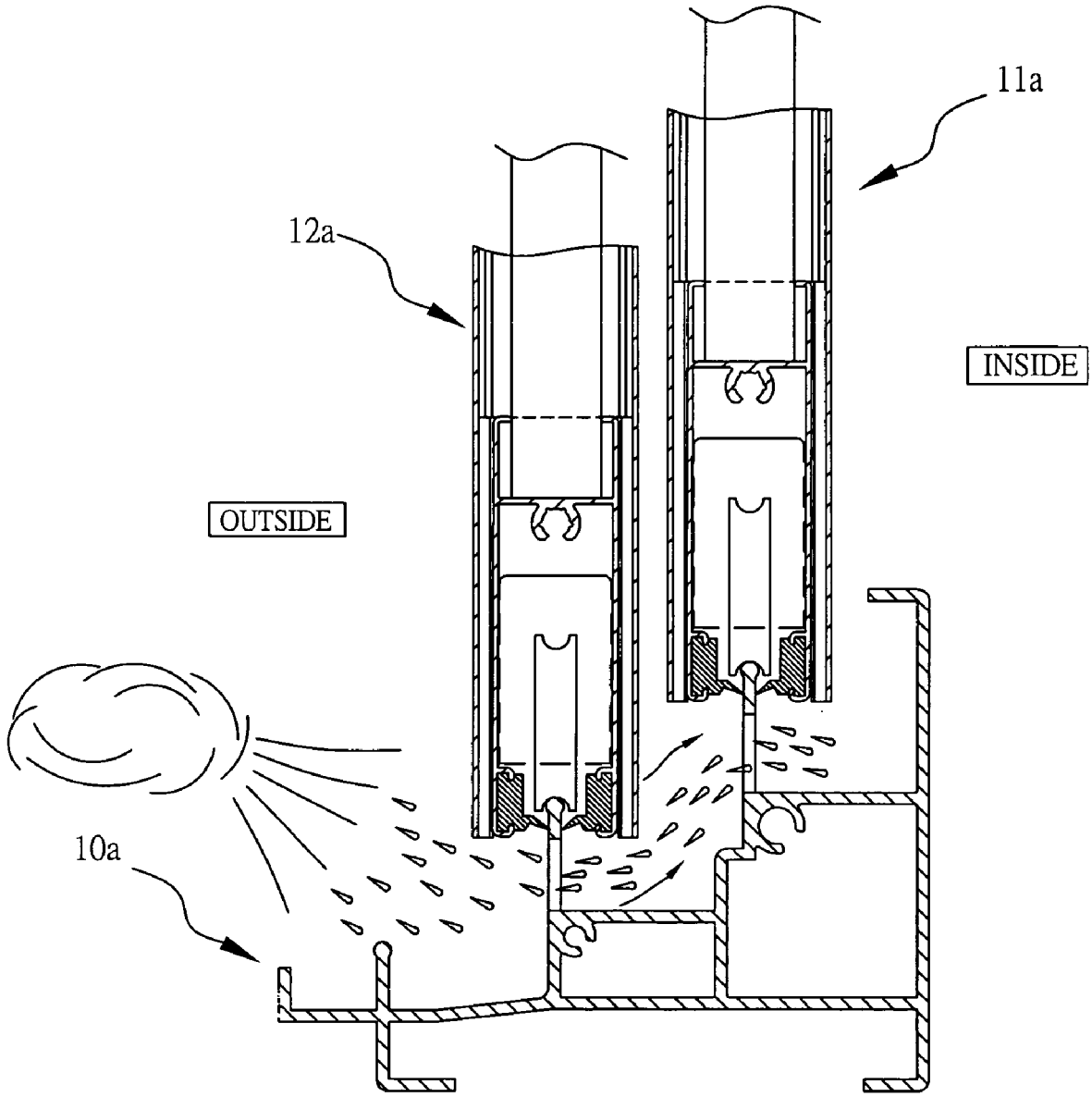
FIG. 2 PRIOR ART
FIG. 2 is a side cross-sectional view of the conventional high-and-low stepped aluminum window in a using condition.
Figure 3:
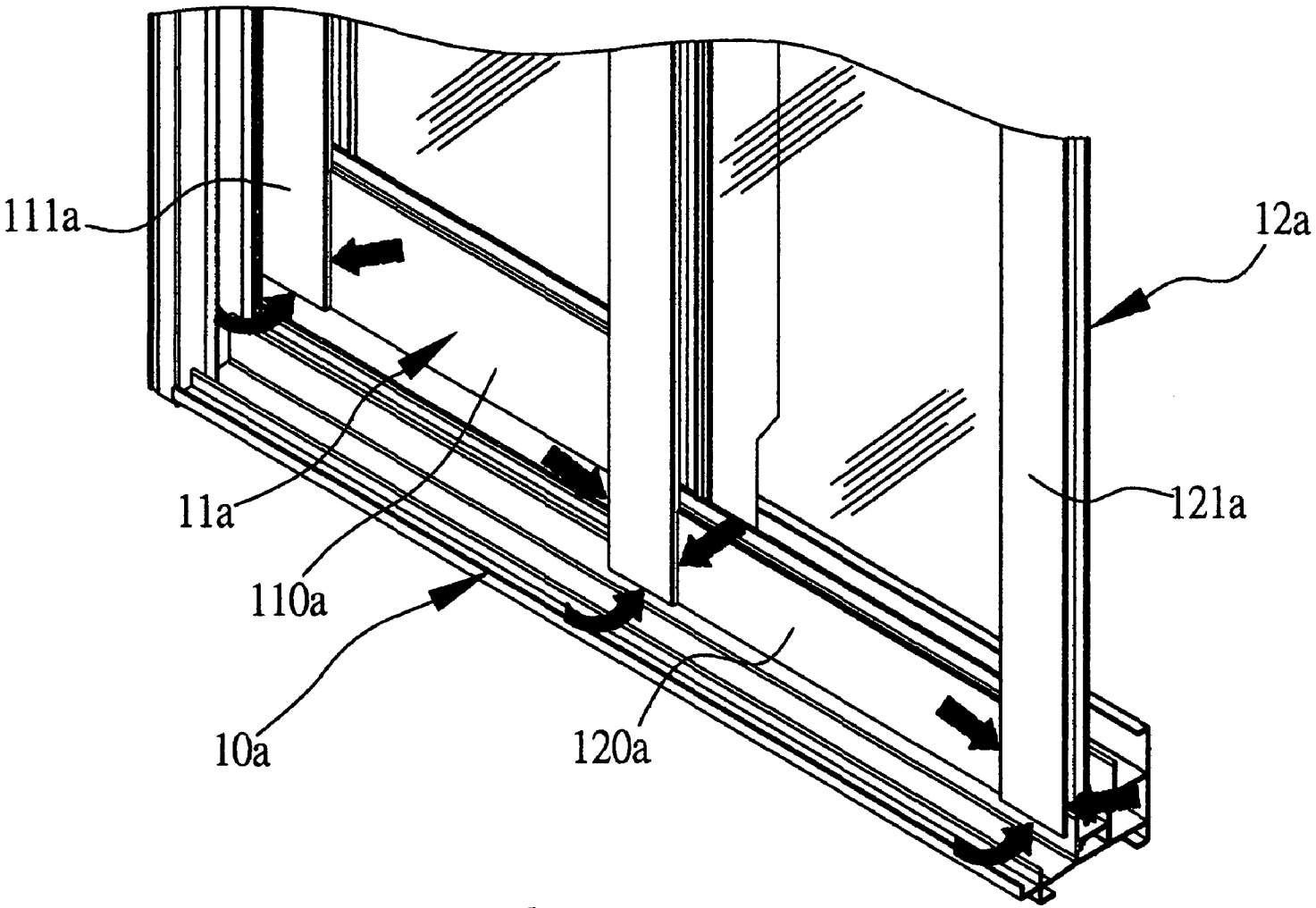
FIG. 3 PRIOR ART
FIG. 3 is perspective view of the conventional high-and-low stepped aluminum window.
Figure 4:
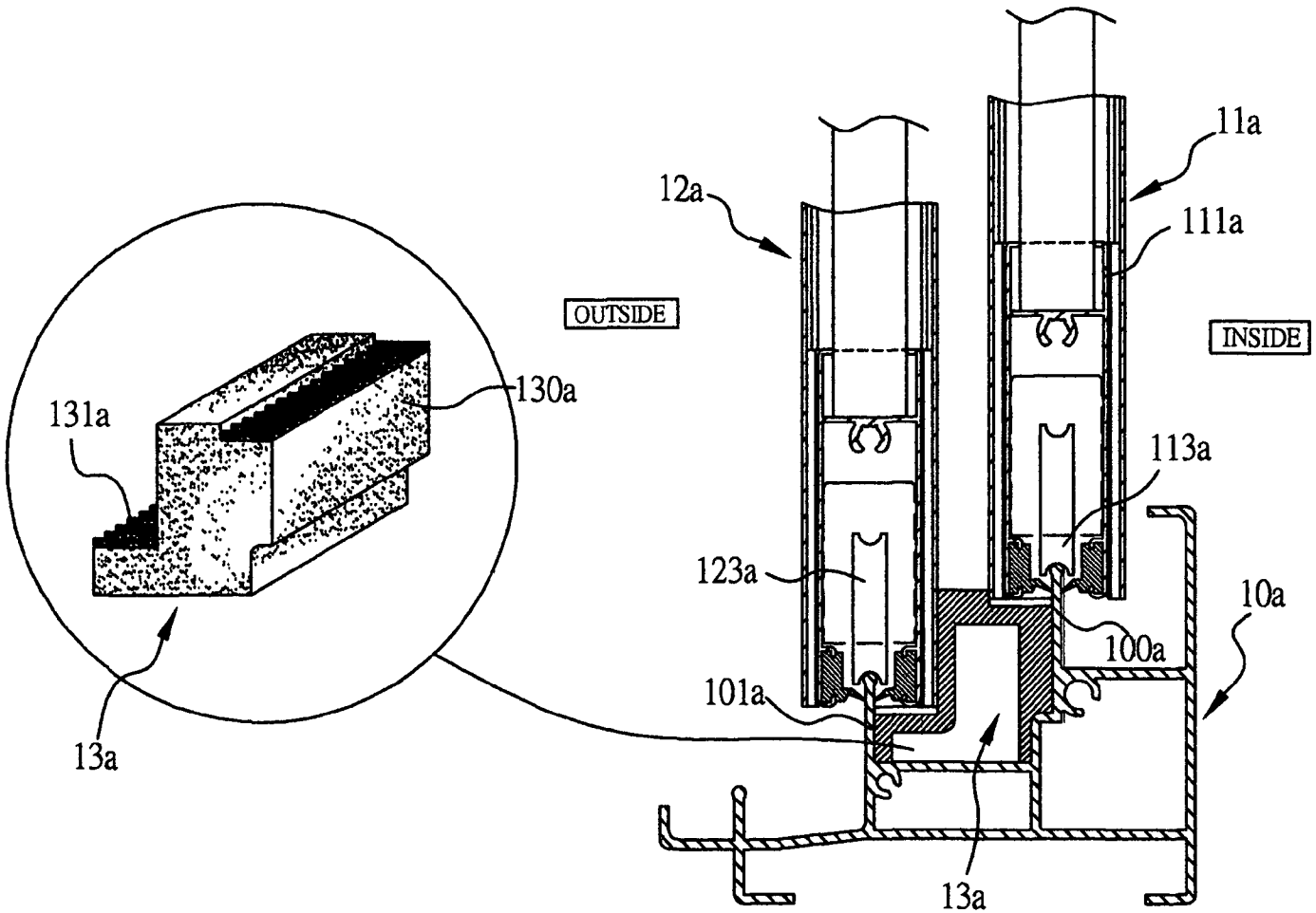
FIG. 4 PRIOR ART
FIG. 4 is another side cross-sectional view of the conventional high-and-low stepped aluminum window provided with waterproof blocks.
Figure 5:
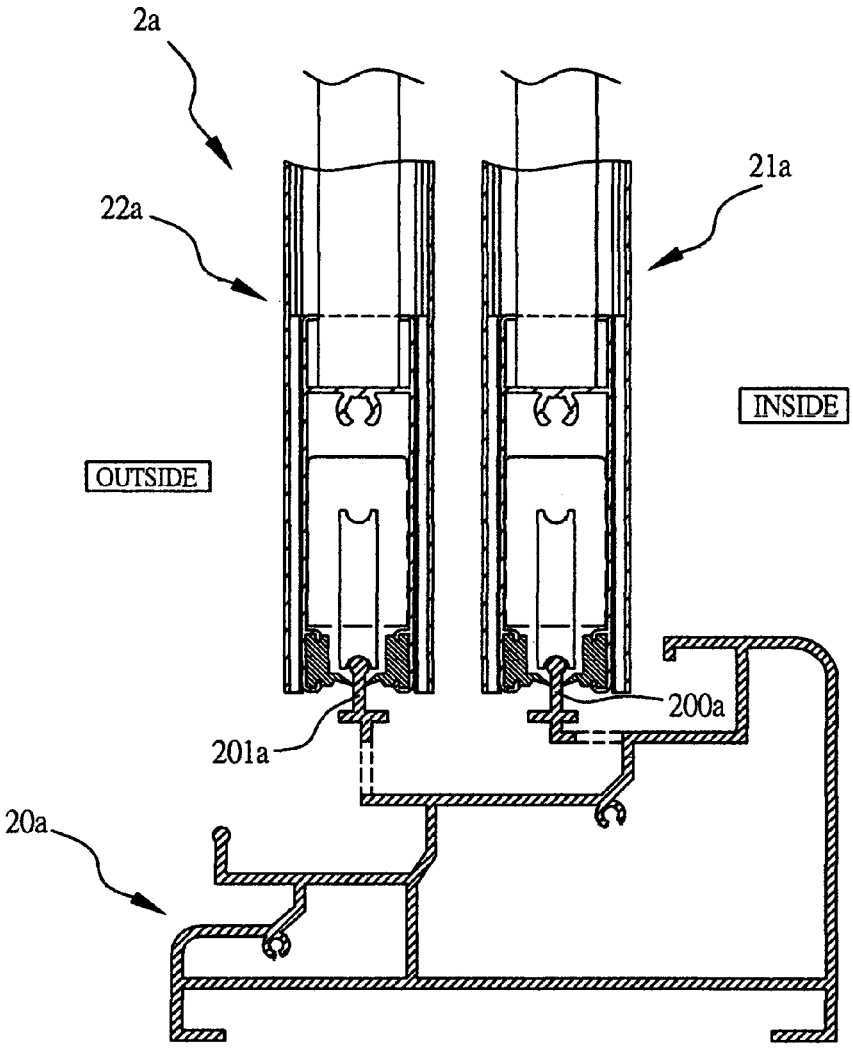
FIG. 5 PRIOR ART
FIG. 5 is a side cross-sectional view of a conventional flat-stepped window.
Figure 6:
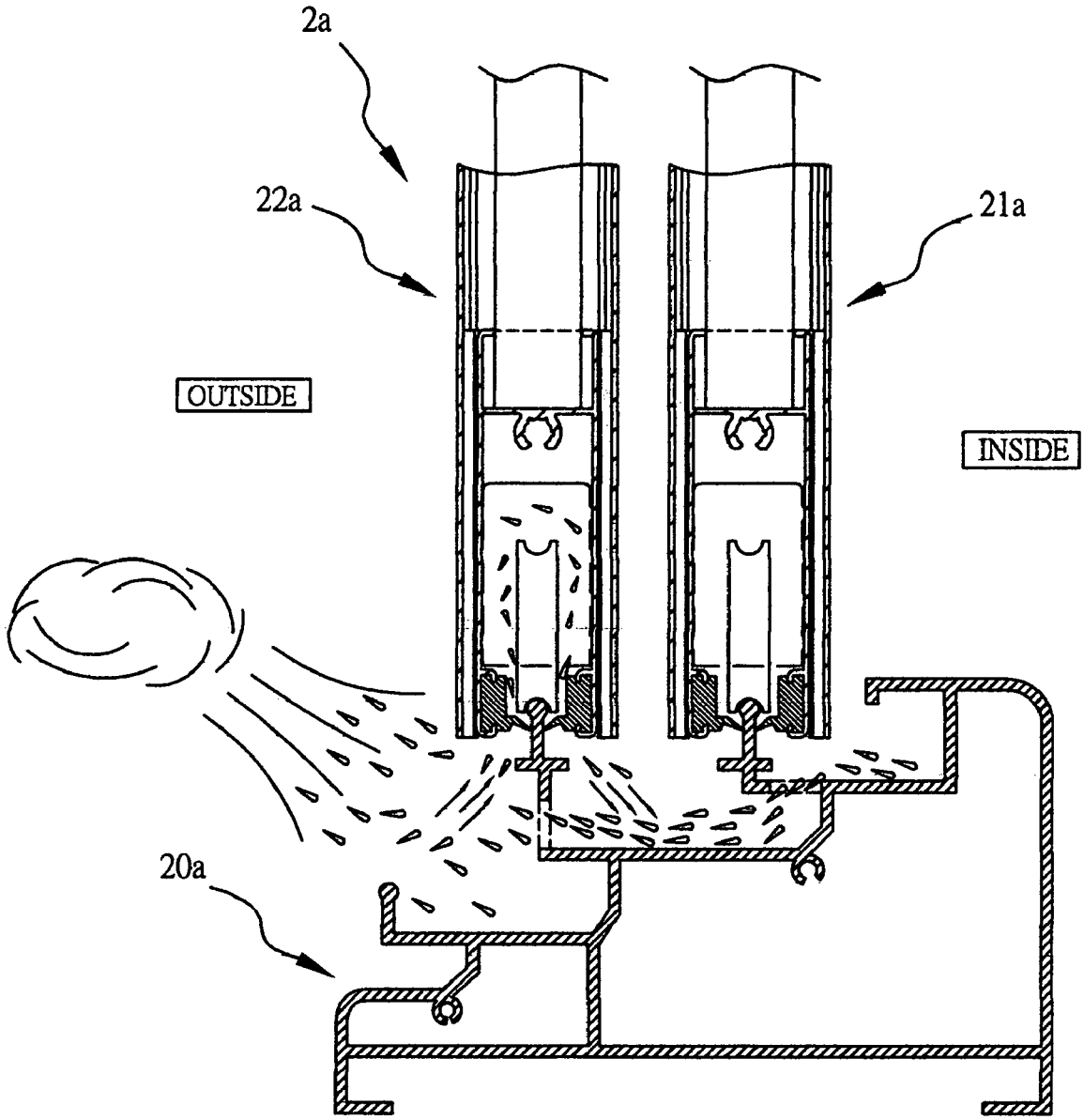
FIG. 6 PRIOR ART
FIG. 6 is a side cross-sectional view of the conventional flat-stepped window in a using condition.
Figure 7:
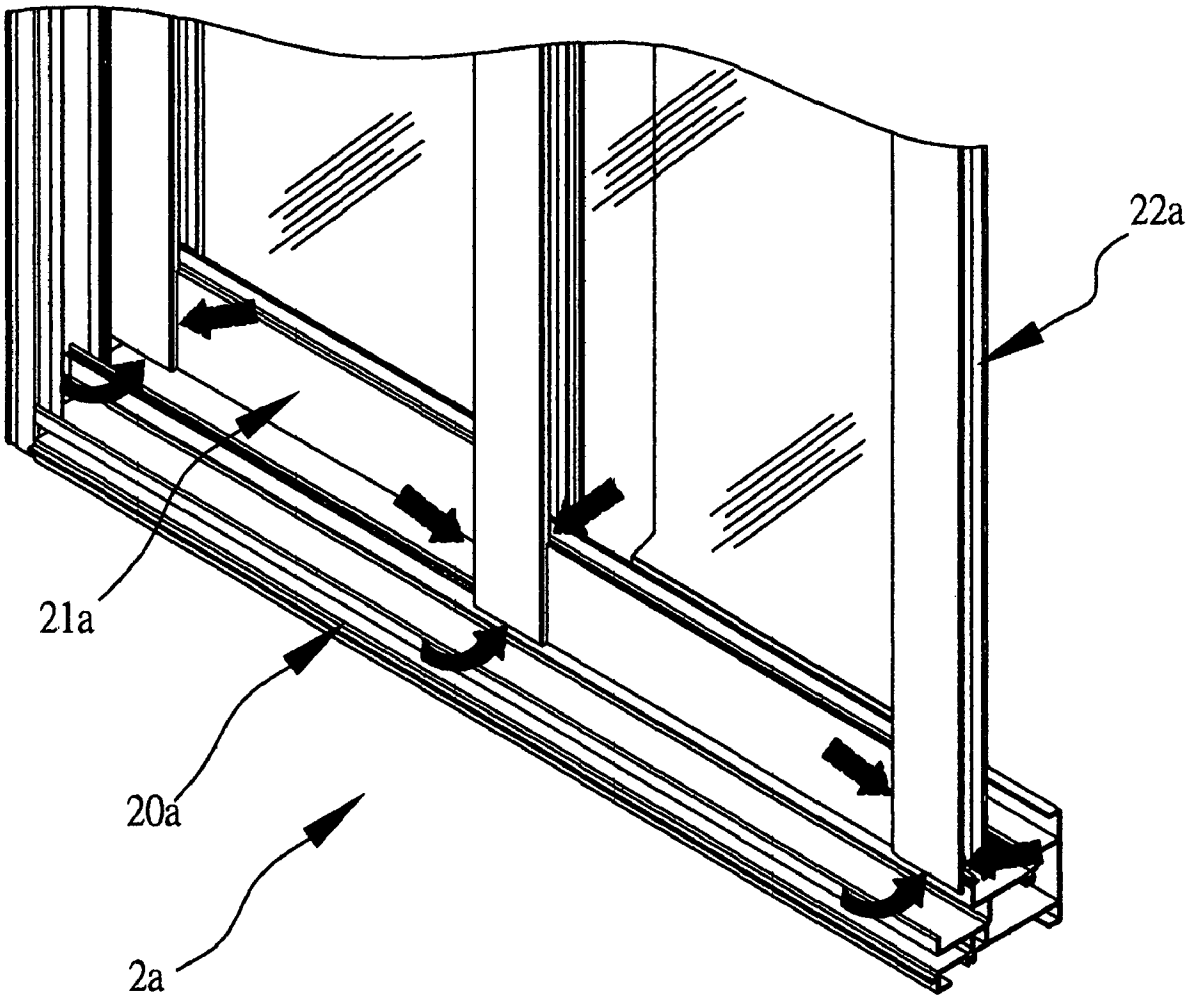
FIG. 7 PRIOR ART
FIG. 7 is perspective view of the conventional flat-stepped window.
Figure 8:
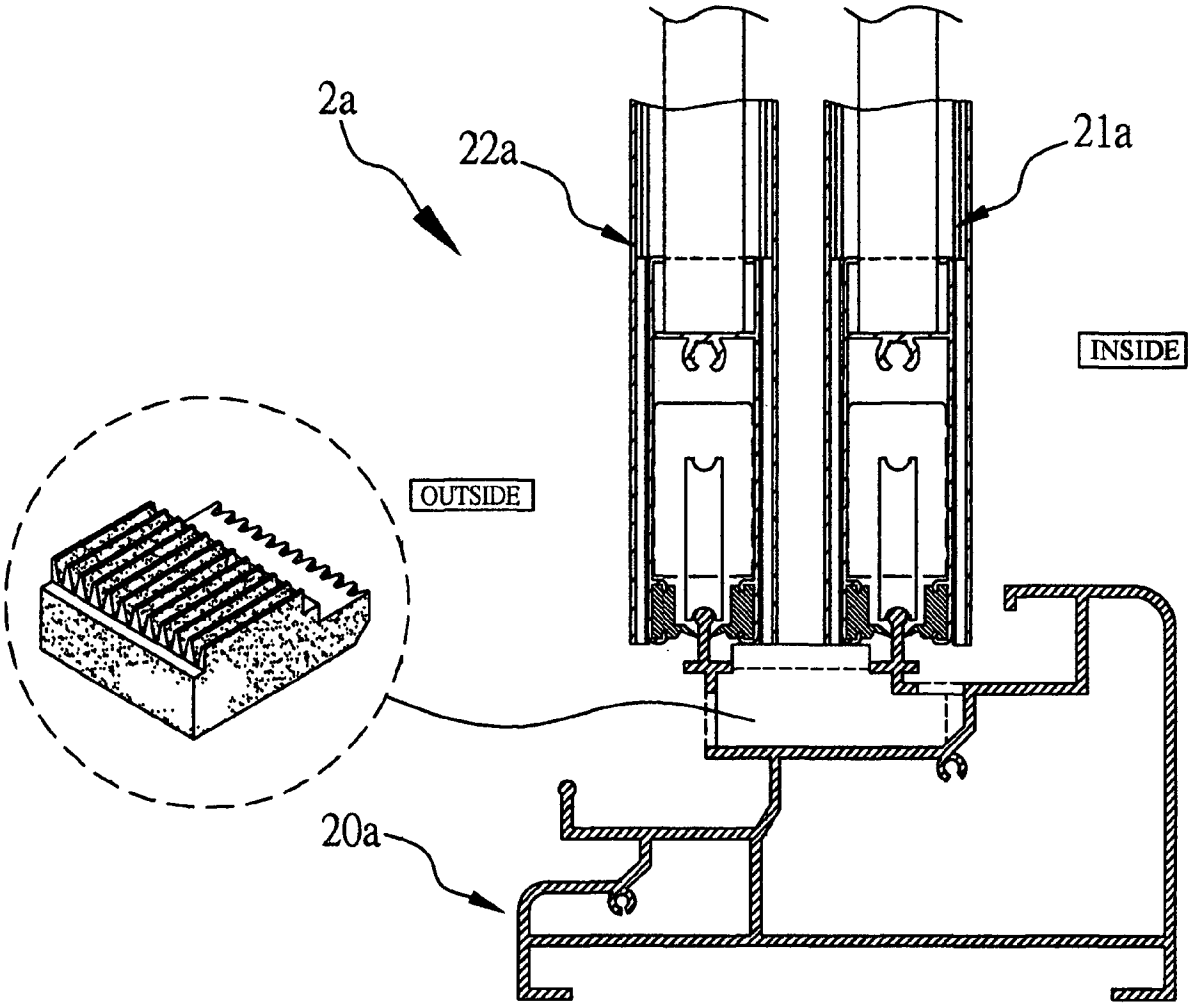
FIG. 8 PRIOR ART
FIG. 8 is another side cross-sectional view of the conventional flat-stepped window provided with waterproof blocks.
Figure 9:
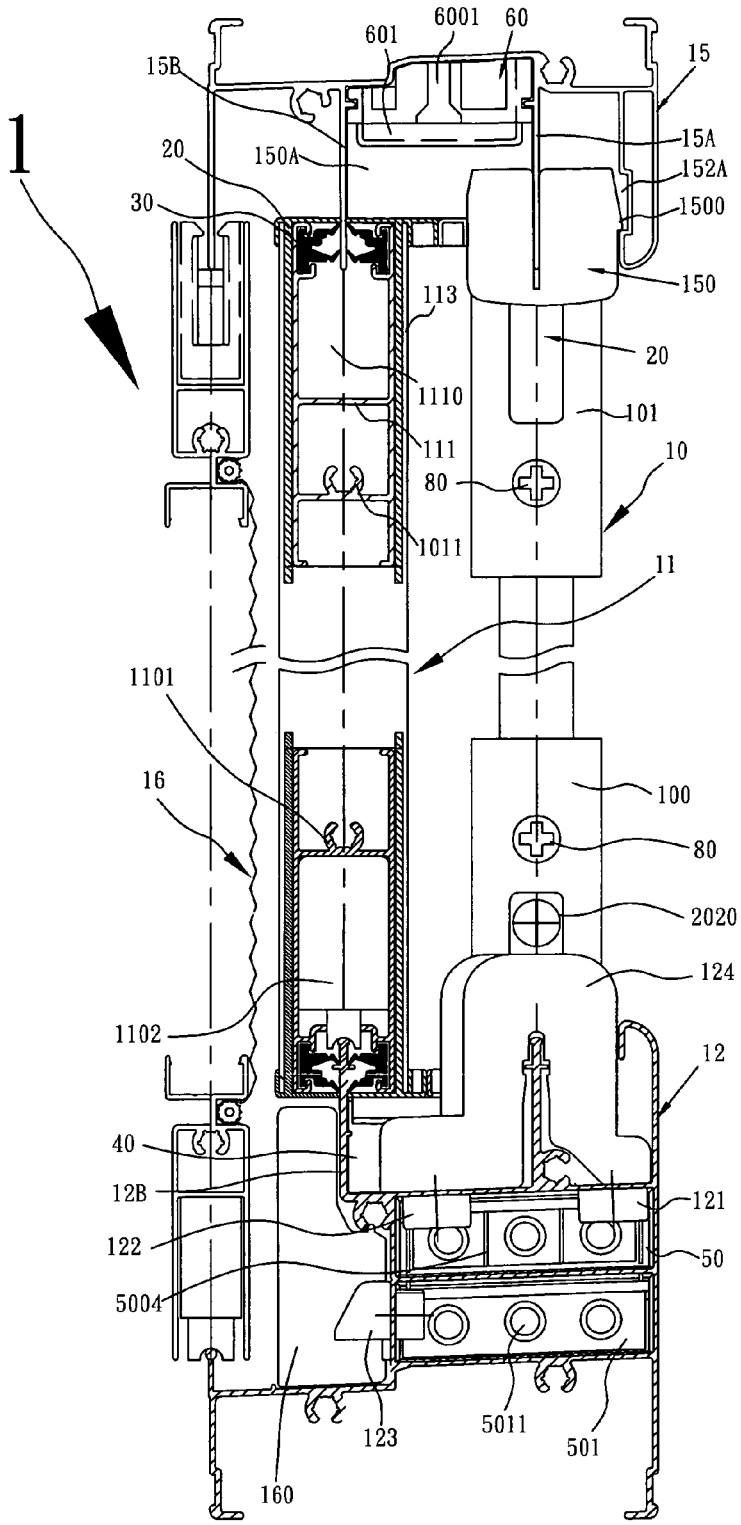
FIG. 9 is a side cross-sectional view of a wind and rain-preventing device for an aluminum window in the present invention.
Figure 10:
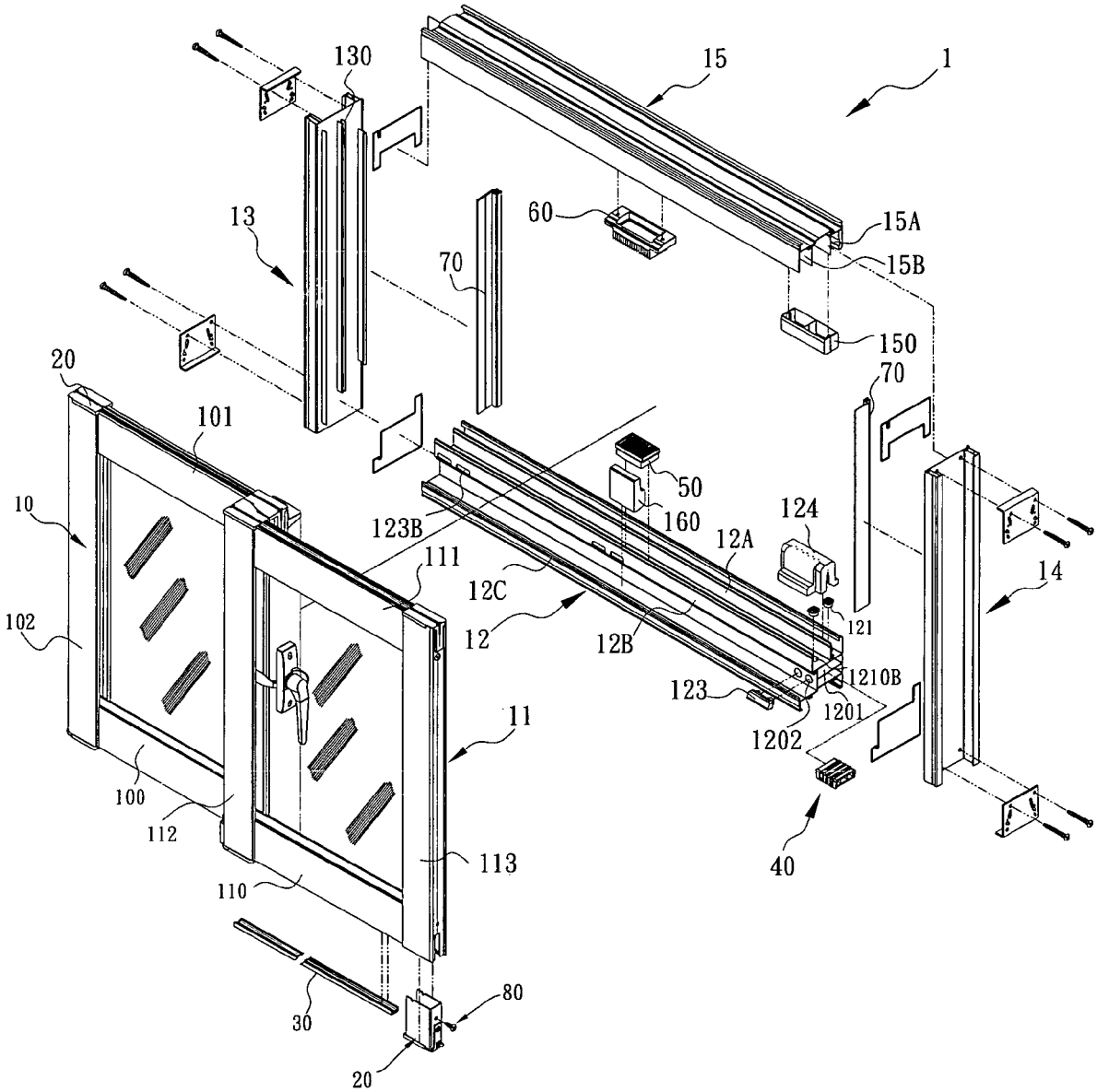
FIG. 10 is an exploded perspective view of the wind and rain-preventing device for an aluminum window in the present invention.
Figure 13:
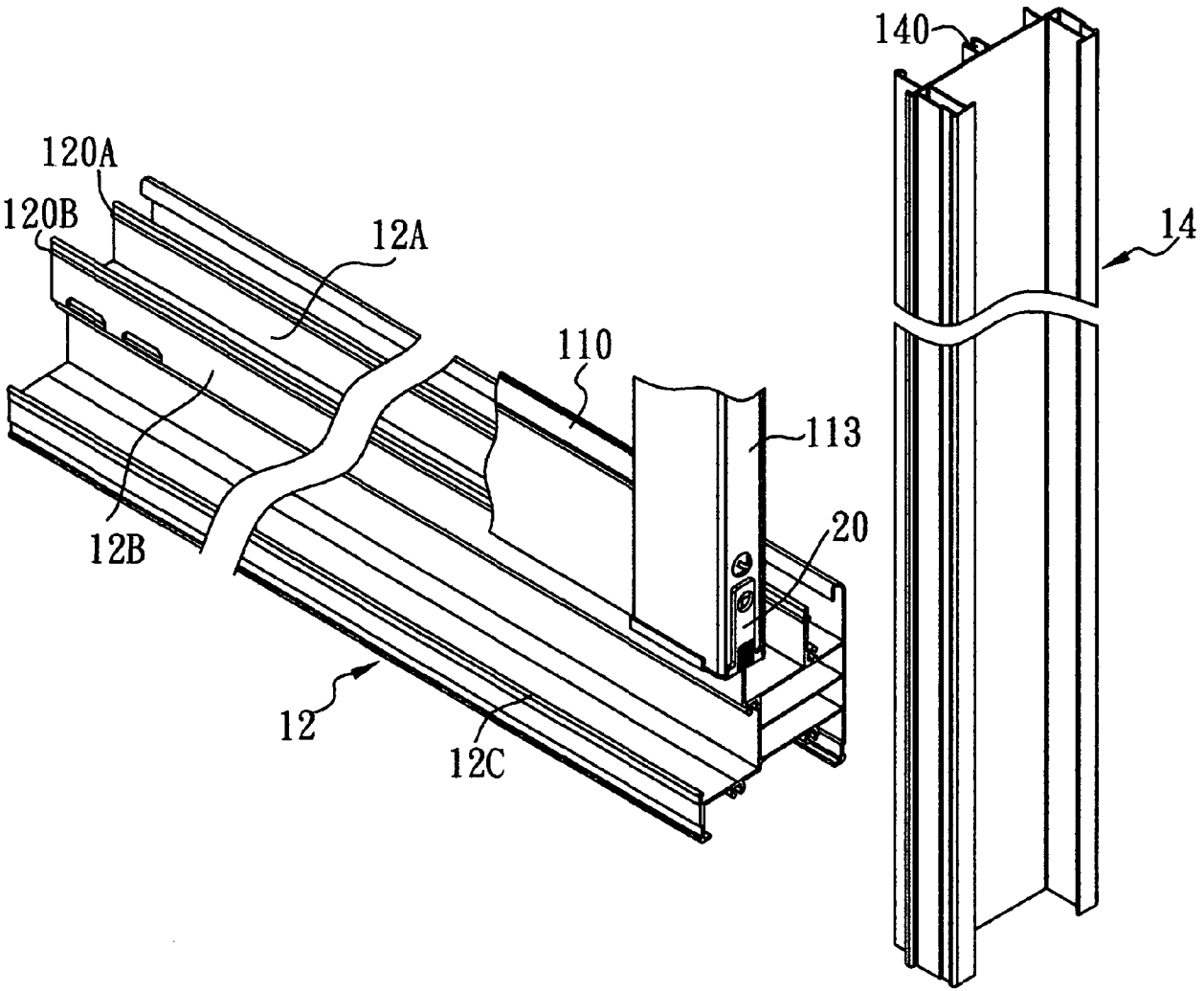
FIG. 13 is a partial perspective view of the covering-and-clogging casing shown in FIG. 12 in a positioning condition.

A first preferred embodiment of a wind and rain preventing device for aluminum doors and windows in the present invention, as shown in FIGS. 9 to 13, includes a window structure made of an inner window 10, an outer window 11, a lower frame 12, two side frames 13, 14 and an upper frame 15. The wind and rain preventing device consists of plural covering-and-clogging casings 20, plural water-preventing elongate members 30, a lower wind-and-rain-preventing block 40, plural draining valves 50, an upper wind-and-rain-preventing block 60, and plural collision-preventing and airtight elongate members 70 as main components combined together.

The inner and the outer window 10, 11 are respectively formed with a window structure made of two symmetrical horizontal window frames 100, 1101 and 110, 111 and two symmetrical vertical window frames 102, 103 and 112, 113. Each horizontal window frame 100, 101, 110, 111 has its hollow interior formed with an accommodating space 1000, 1010, 1100, 1110 respectively having the inner upper end provided with a threaded locking member 1001, 1011, 1101, 1111. The lower horizontal frame 100, 110 of the inner and the outer window 10, 11 have their accommodating space 1000, 1010 respectively fixed therein with a roller 1002, 1012. Further, the accommodating space 1000, 1010, 1100, 1110 respectively have the opposite sides of the inner lower edge of the downward opening formed with an engage groove 1003, 1013, 1102, 1112. The vertical window frames 102, 103, 112, 113 have their hollow interiors respectively formed with a sheet separating member 1020, 1030, 1120, 1130 respectively having a depositing groove 1021, 1031 1121, 1131. Further, the vertical window frame 102, 103, 112, 113 respectively have one outer side formed with a slide-guiding groove 1022, 1032, 1122, 1132 and the other outer side formed with a guiding-in groove 1023, 1033, 1123, and 1133.

In assembling, the vertical window frame 102, 103, 112, 113 have their upper and lower end respectively covered on the outer peripheral sides of the left and the right end of the horizontal window frame 100, 101, 110, 111. After the vertical window frame 102, 103,112,113 are assembled together with the horizontal window frame 100, 101, 110, 111 to make up a window structure, the covering-and-clogging casings 20 are respectively fitted on the joint corners of the peripheral edge of the horizontal and the vertical window frames so as to clog and seal up the gaps formed at the joint corners of the window structure. Each sealing casing 20 is made of plastic and composed of a clogging body 200, a bottom sealing plate 201 and a front blocking plate 202. The clogging body 200 has its inner side fitted with the horizontal window frame 100, 101, 110, 111 and its outer side fitted with the vertical window frame 102, 103, 112, 113. The clogging body 200 of the covering-and-clogging casing 20 has its outer side bored with a locking hole 2001 at a proper location. The clogging body 200 of the covering-and-clogging casing 20 is able to clog and seal up the gaps formed at the joint corners of the horizontal window frames 100, 101, 110, 111 and the vertical window frames 102, 103, 112, 113. The covering-and-clogging casings 20 are respectively locked together with the horizontal and the vertical window frames by means of screws 80 respectively screwed in the locking holes 2001 of the covering-and-clogging casings 20. In addition, the clogging body 200 is formed integral with a slide-guiding member 2002 under the locking hole 2001 to be fitted and positioned in the slide-guiding groove 1022, 1032, 1122, and 1132 of the vertical window frame 102, 103, 112, 113. The slide-guiding member 2002 of the clogging body 200 has its outer side disposed with a front blocking member 202 for stopping rainwater and strong wind as well as soil from getting in the vertical window frame 102, 103, 112, 113. The front blocking member 202 is bored with an adjusting hole 2020 for facilitating adjusting the rollers 1002, 1012 in the horizontal window frame 100, 110. The adjusting hole 2020 is fitted inside with a plastic fin-shaped hole member 2021 able to recover its original state and position after it is pulled and able to cover the adjusting hole 2020 for preventing rainwater and soil from getting in the adjusting hole 2020. The front blocking member 202 has its lower edge provided with plural sheet-shaped water-blocking members 2022 for stopping rainwater and soil from entering the vertical window frame 102, 103, 112, 113. Further, the clogging body 200 is formed integral with a flat bottom sealing plate 201 at the underside for sealing up the end opening of the vertical window frame 102, 103, 112, 113 and closely covering the joint portion of the horizontal window frame 100, 101, 110, 111 and the vertical window frame

102, 103, 112, 113 for stopping rain water and strong wind from getting inside. The bottom sealing plate 201 has its opposite sides respectively extending upward and forming a projection 2010 for sealing up the gaps formed between the bottom sealing plate 201 and the vertical window frame 102, 103, 112, 113 and blocking rain water and soil. The bottom sealing plate 201 has its central portion of its underside bored with a lengthwise slide rail groove 2011 to be engaged with the slide rail for sliding.

The lower frame 12 positioned at the bottom edge of the inner and the outer window 10, 11 have its topside formed with a flat surface or a stepped surface. The lower frame 12 has its topside surface provided with an inner window slide rail 12A, an outer window slide rail 12B and a window screen slide rail 12*c* respectively for assembling thereon one or more inner window 10, outer window 11 and window screen 16. The inner window rail 12A and the outer window rail 12B have there opposite sides respectively formed with a horizontal elongate projecting member 120A, 120B having functions of engaging and water blocking. The slide rail groove 2011 under the bottom of the covering-and-clogging casing 20 is guided and engaged with the inner and the outer window rail 12A, 12B on the lower frame 12 and the sheeted water-blocking member 2022 of the covering-and-clogging casing 20 is engaged on the elongate projecting members 120A, 120B of the inner and the outer window slide rail 12A, 12B to prevent rain water from getting in the vertical window frames 102, 103 112, 113 and the horizontal window frames 100, 110 through the elongate projecting members 120A, 120B. Evidently, the covering-and-clogging casings 20 closely mounted at the joint corners of the horizontal window frames 100, 101, 110, 111 and the vertical window frames 102, 103, 112, 113 are able to block strong wind and heavy rain.

The covering-and-clogging casings 20 can be designed into different types to match with different-shaped joint corners of the lower frame and the horizontal window frames 100, 101, 110, 111 and the vertical window frames 102, 103, 112, 113, as shown in FIGS. 14-*a*, 14-*b* 14-*c*, 15-*a*, 15-*b*, 15-*c* and 15-*d*.

Figure 16:
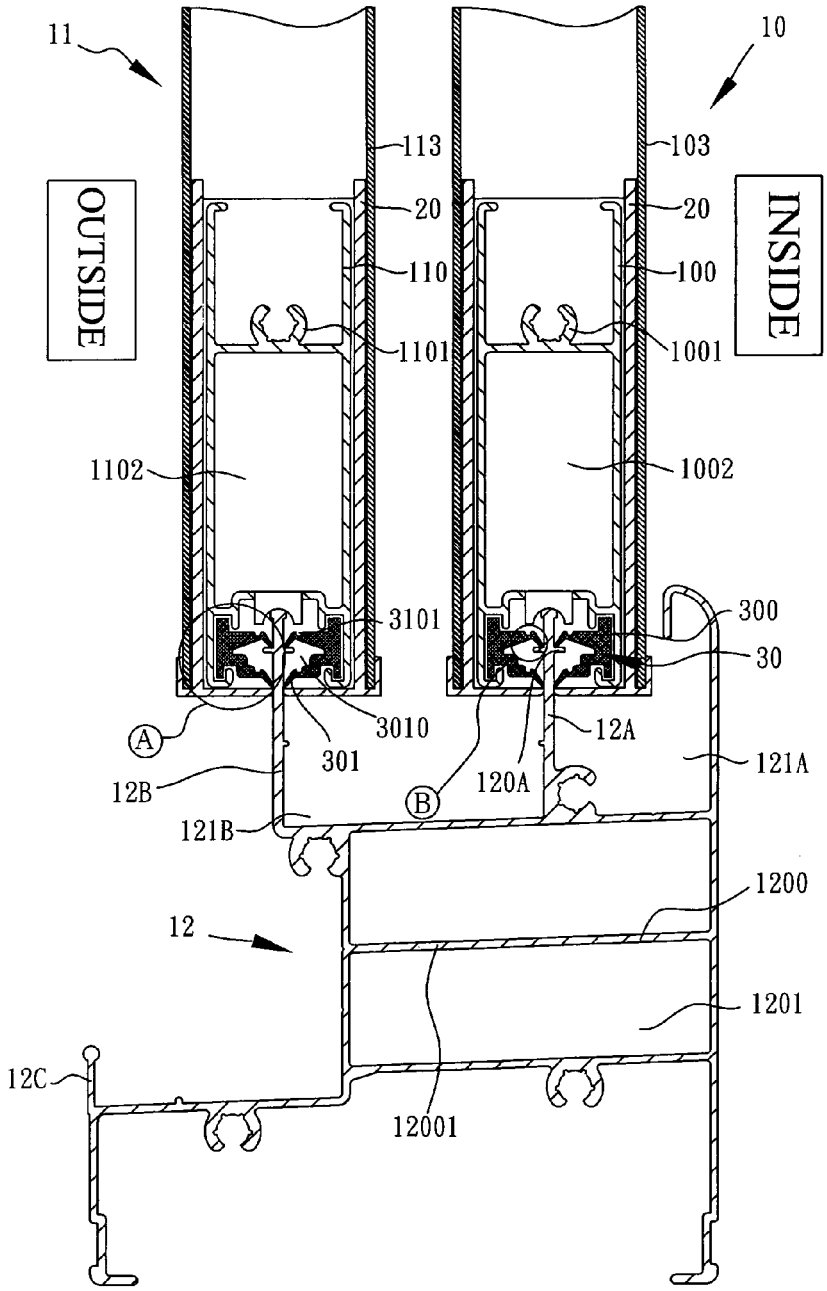
FIG. 16 is a partial side cross-sectional view of the wind and rain-preventing device provided with waterproof elongate members in the present invention.
Figure 17:
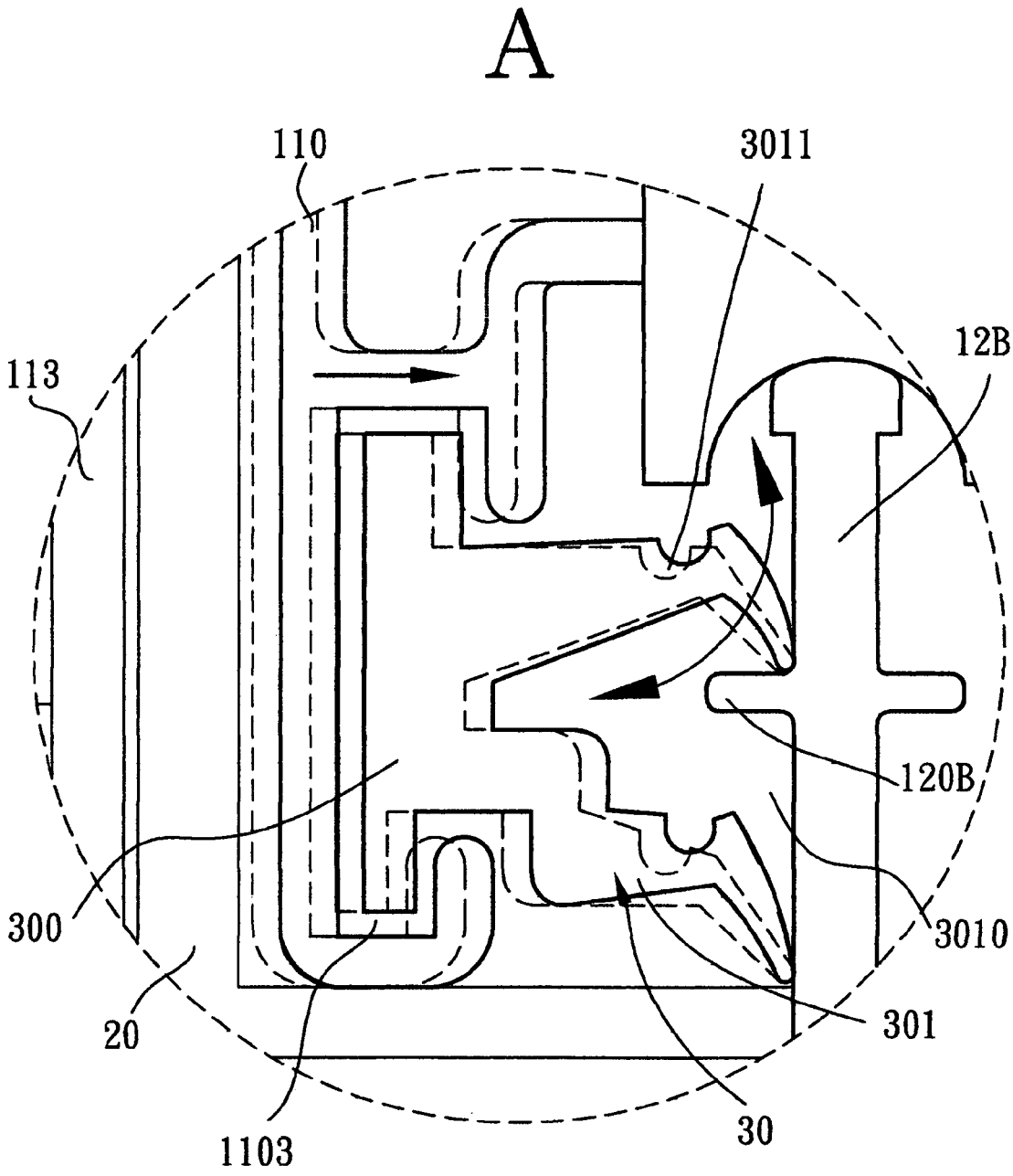
FIG. 17 a partial magnified view of the waterproof elongate member indicated by the part A in FIG. 16.
Figure 18:
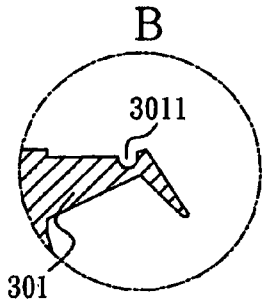
FIG. 18 is a partial magnified view of the water-preventing elongate member indicated by the part B in FIG. 16.
Figure 19:
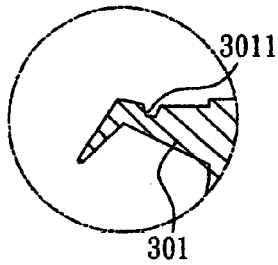
FIG. 19 is a front view of a first preferred embodiment of the waterproof elongate member indicated by the part B in FIG. 16.
Figure 20:
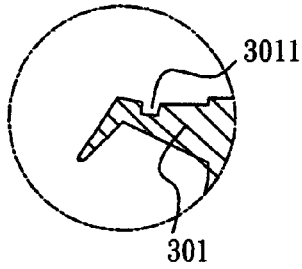
FIG. 20 is a front view of a second preferred embodiment of the waterproof elongate member indicated by the part B in FIG. 16.
Figure 21:
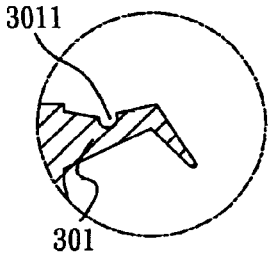
FIG. 21 is a front view of a third preferred embodiment of the waterproof elongate member indicated by the part B in FIG. 16.
Figure 22:
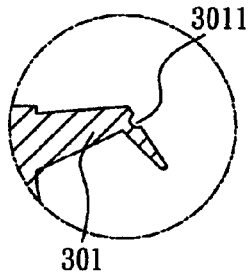
FIG. 22 is a front view of a fourth preferred embodiment of the waterproof elongate member indicated by the part B in FIG. 16.
Figure 23:
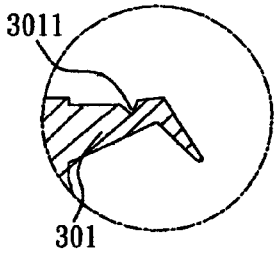
FIG. 23 is a front view of the water-preventing elongate member indicated by the part B in FIG. 16.

Each covering-and-clogging casing 20, as shown in FIGS. 16, 17 and 18, is provided with an elongate waterproof member 30 composed of an engage portion 300 and a projecting portion 301. The engage portion 300 is engaged in the engage groove 1013, 1003, 1102, 1112 in the opposite sides at the inner lower open edge of the horizontal window frame 100, 101, 110, 111 of the inner and the outer windows 10, 11. The projecting portion 301 has one end contacting with the elongate projecting members 120A, 120B on the inner and the outer window slide rail 12A, 12B of the lower frame 12 for stopping rain water and strong wind from getting in the horizontal window frames 100, 101, 110, 111 of the inner and outer windows 10, 11. The projecting portion 301 of the elongate water-proof member 30 has its upper side formed with a recessed elastic space 3011 for facilitating the projecting portion 301 to move inward and rebound when it is pushed by strong wind or by an external force. In other words, the projecting portion 301 of the elongate waterproof member 30 can recover its original state and position for blocking wind and rain anytime. Each engage portion 300 of the elongate waterproof member 30 can be provided thereon with one or more projecting portions 301. Thus, the peripheral edge and the joint corners of the peripheral edge of the vertical window frame 102, 103, 112, 113 and the horizontal window frame 100, 101, 110, 111 of the inner and the outer window 10, 11 can be completely sealed up by both the covering-and-clogging casings 20 and the elongate water-proof members 30, having excellent effect of prevention of wind and rain.

The elastic space 3010 of the projecting portion 301 of the elongate water-proof member 30 can be designed into different shapes, such as a U shape, a V shape, a square shape or a round shape, according to requirements of elasticity and location of the sheeted portion 301.

Figure 24:
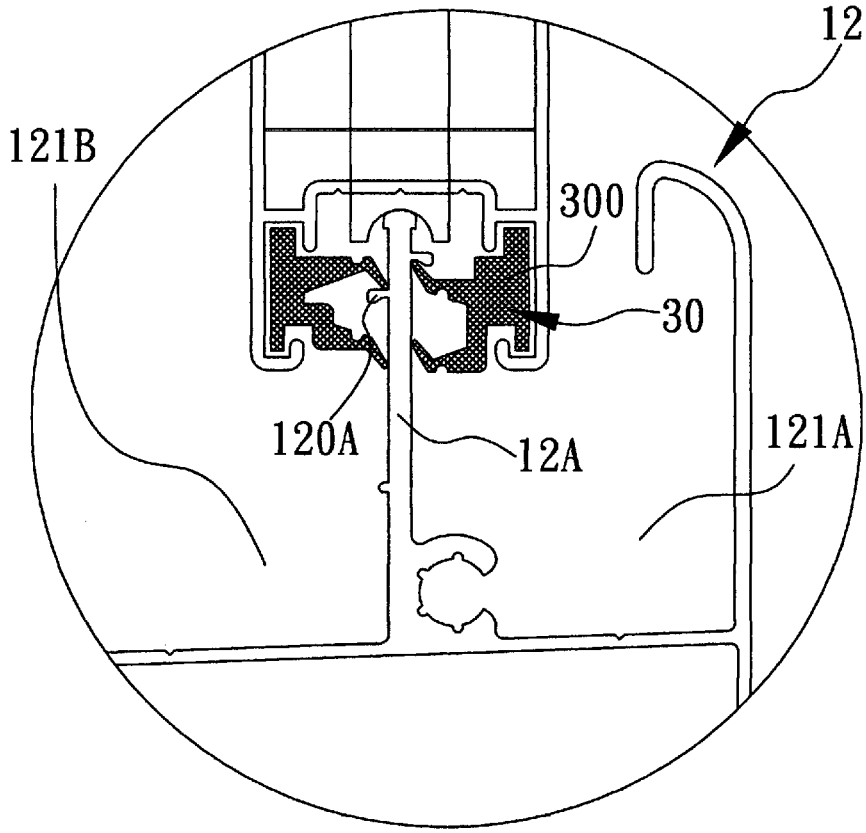
FIG. 24 is a cross-sectional view of a sixth preferred embodiment of the water-preventing elongate members in the present invention.

Different-typed elongate water-proof members 30 can be used to fit in the horizontal window frames 100, 101, 110, 111 of the inner and the outer window 10, 11 for preventing wind and rain, as shown in FIG. 24.

Figure 25:
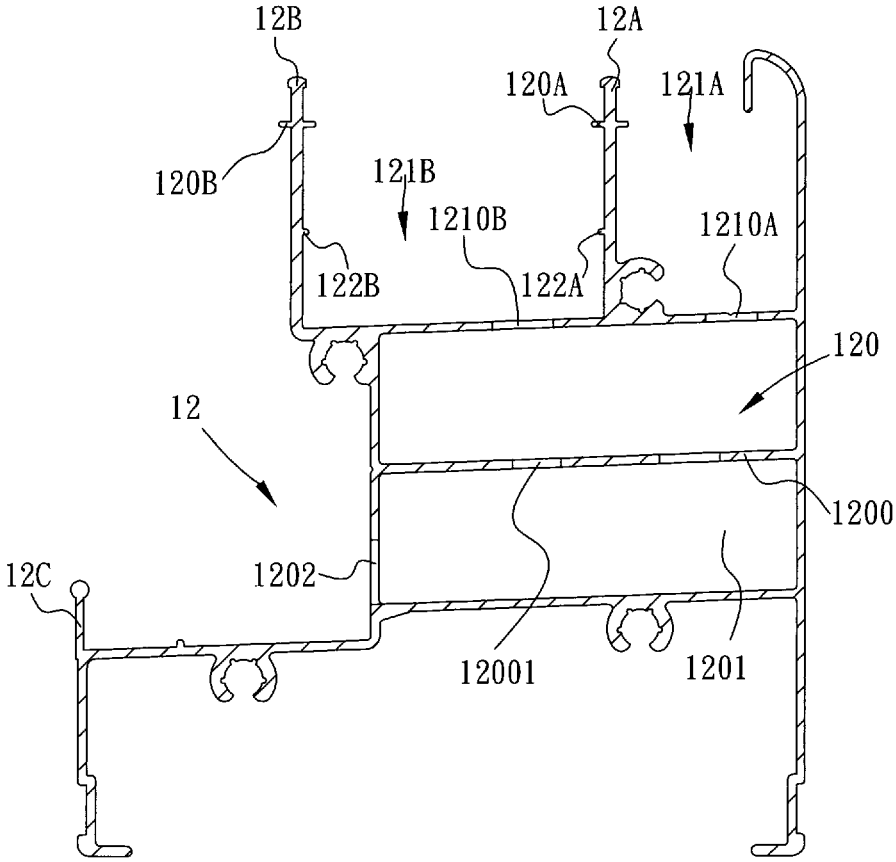
FIG. 25 is a side cross-sectional view of a lower frame in the present invention.
Figure 26:
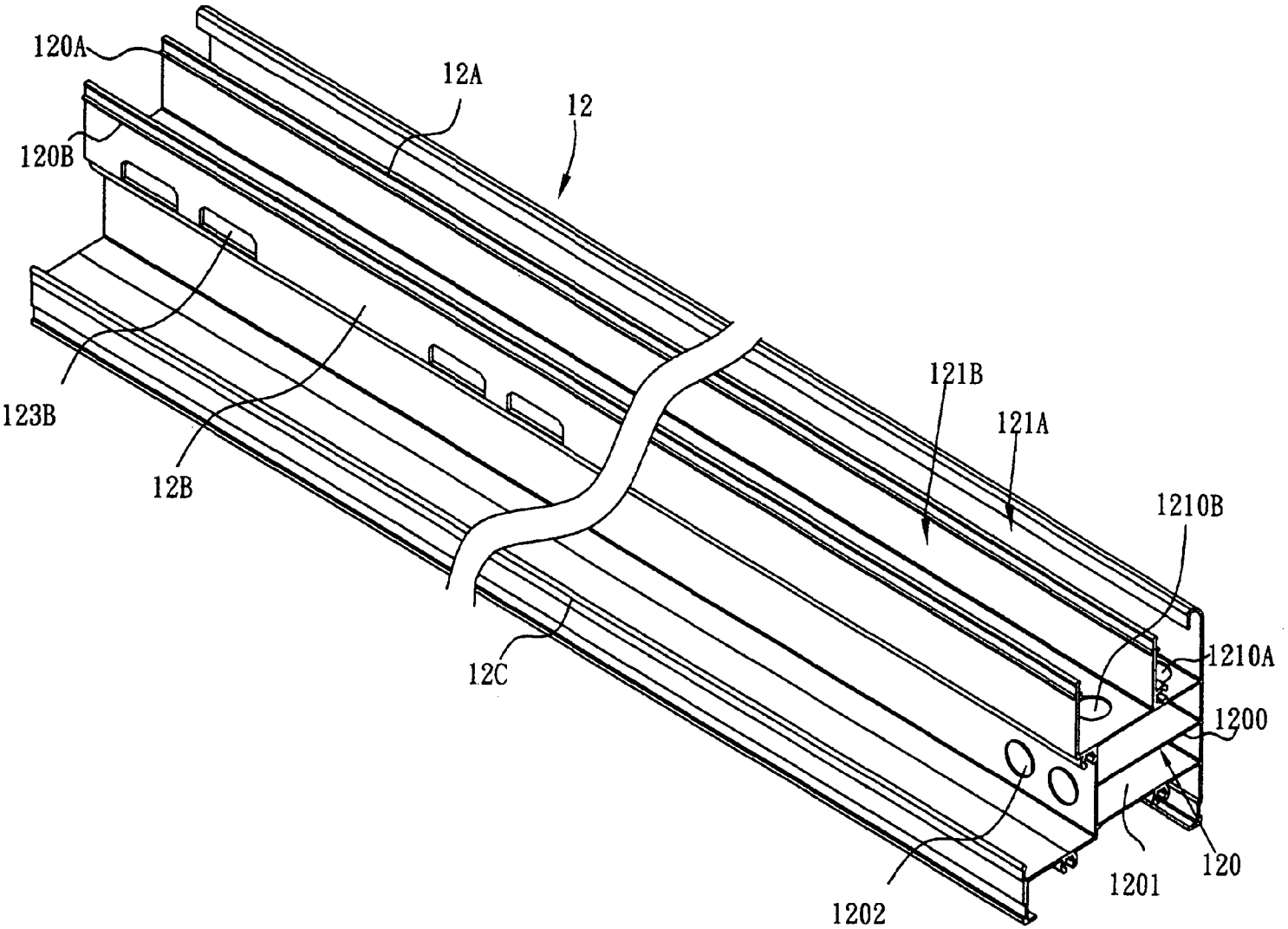
FIG. 26 is a perspective view of a first preferred embodiment of the lower frame in the present invention.

The lower frame 12 in the window structure, as shown in FIGS. 25 and 26, has an inner and an outer window slide rail groove 121A, 121B respectively defining one side of the inner and the outer window slide rail 12A, 12B. The outer window slide rail groove 121B has its inner lower opposite walls abutting the inner and the outer window slide rail 12A, 12B respectively formed with an elongate engage projection 122A, 122B, and the outer window slide rail 12B is bored with a plurality of exhausting holes 123B. Further, the inner and the outer window slide rail groove 121A, 121B of the lower frame 12 have their inner bottoms respectively bored with draining holes 1210A, 1210B. The lower frame 12 has its hollow interior formed with a passageway-shaped inner draining space 120 for reinforcing the whole structure of the lower frame 12. The inner draining space 120 has one or more separating plate 1200 formed integral in the interior to partition the inner draining space 120 into plural draining passageways 1201, which can be shaped as Y, S, Z or W, and the separating plate 1200 is bored with flow holes 12001. The draining holes 1210A and 1210B in the inner and the outer window slide rail groove 121A, 121B communicate with the draining passageway 1201 of the inner draining space 120. The outer window slide rail 12B has its outer side bored with water-exhausting holes 1202 in the lower portion adjacent to the window screen slide rail 12C. Thus, the draining holes 1210A, 1210B bored in the inner and the outer window slide rail groove 121A, 121B and the water-exhausting holes 1202 of the outer window slide rail 12B as well as the flow holes 12001 of the separating plate 120 together make up an inner drainage system. This inner drainage system, which is based on the principle of lengthening the draining route of the lower frame 12, with cooperation of different-typed inner draining spaces 120 can produce different water pressures. Thus, rain water gathered in the inner and the outer window slide rail groove 121A, 121B can flow into the inner draining space 120 and then slowly flows to the outside of a room without being affected by external wind.

Figure 27:
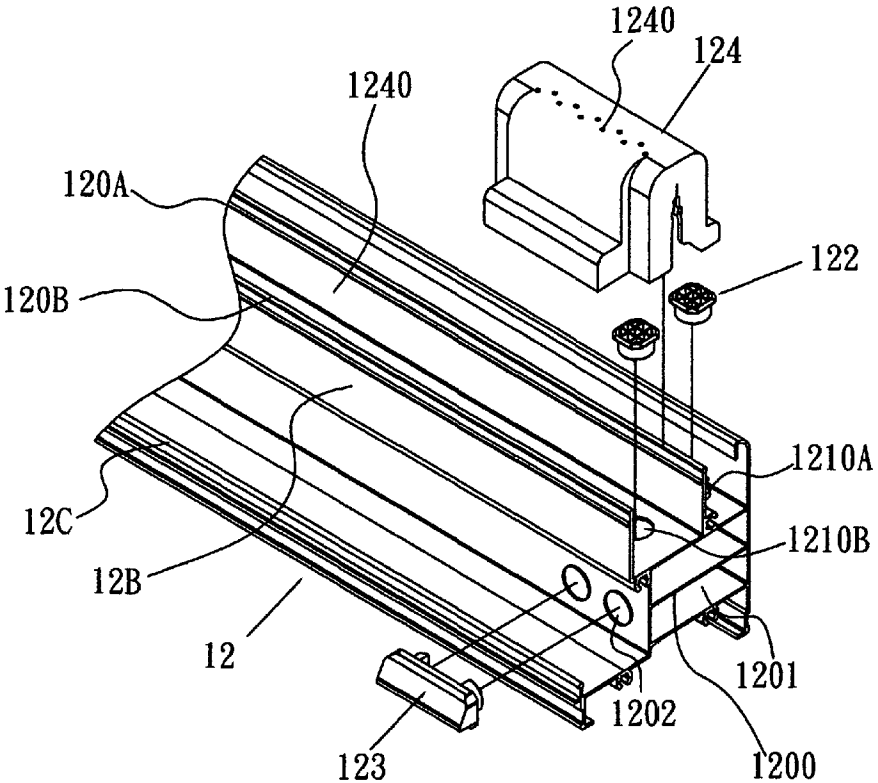
FIG. 27 is a partial exploded perspective view of unmovable outer-covering hole plugs in an assembling condition in the present invention.
Figure 28:
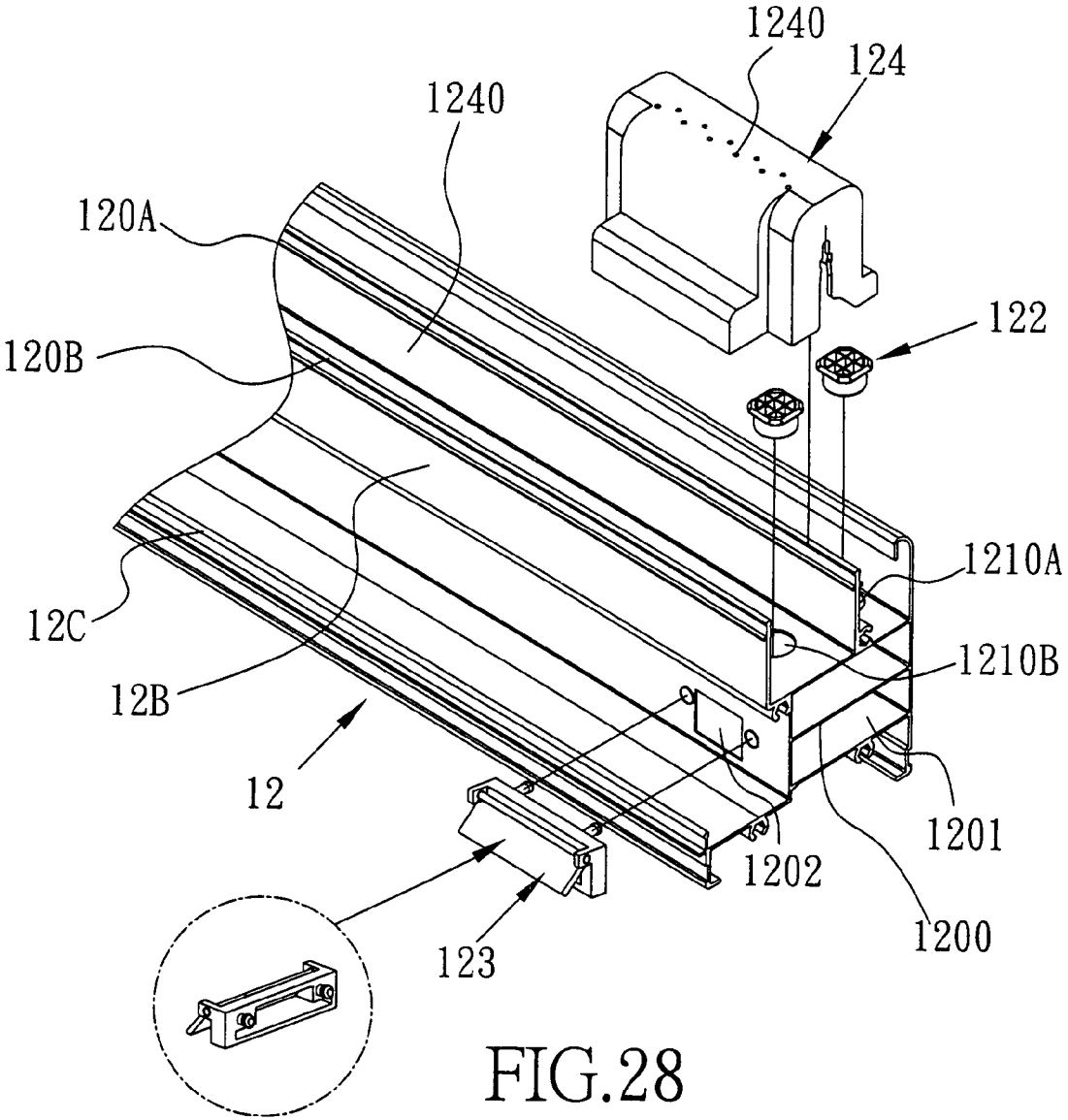
FIG. 28 is a partial exploded perspective view of a first movable outer-covering hole plugs in an assembling condition in the present invention.
Figure 29:
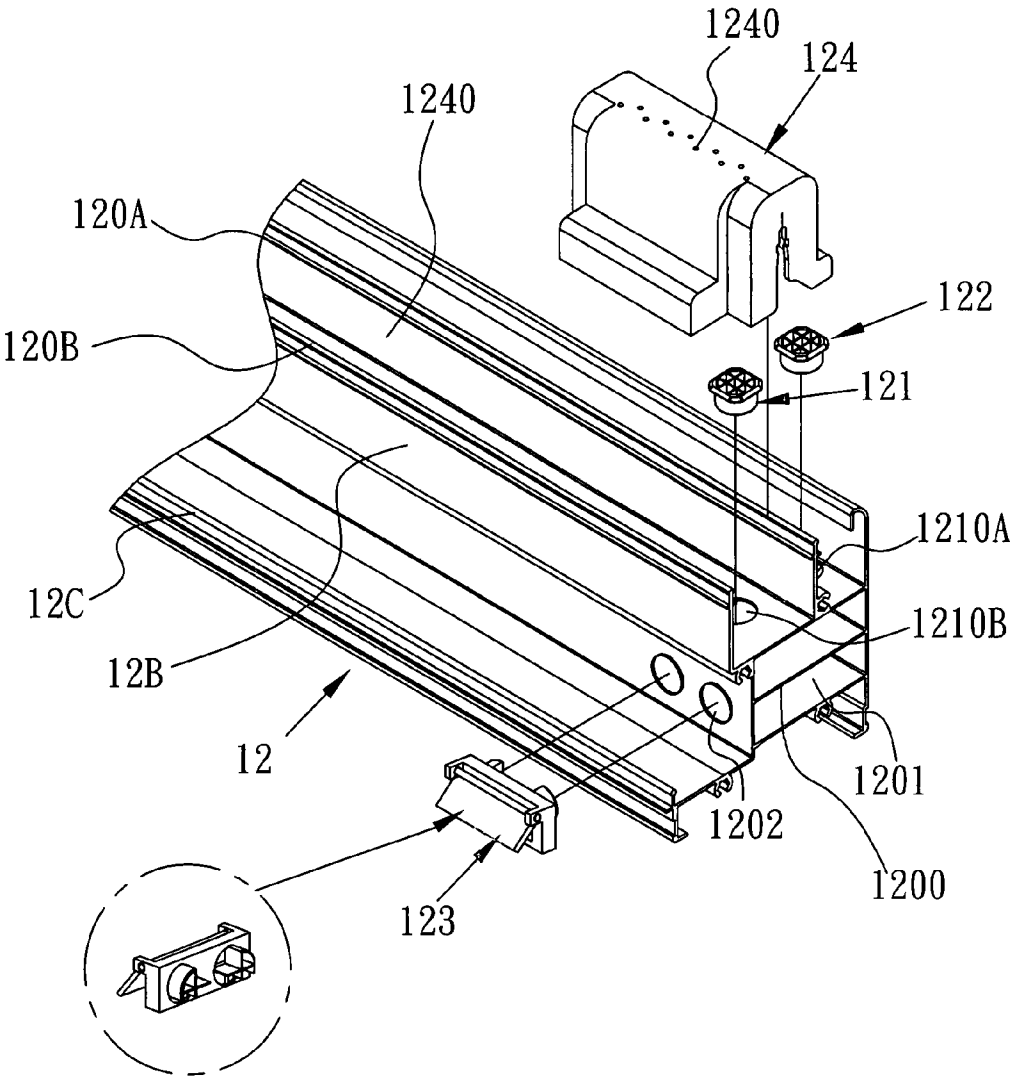
FIG. 29 is a partial exploded perspective view of a second outer-covering hole plugs in an assembling condition in the present invention.
Figure 30:
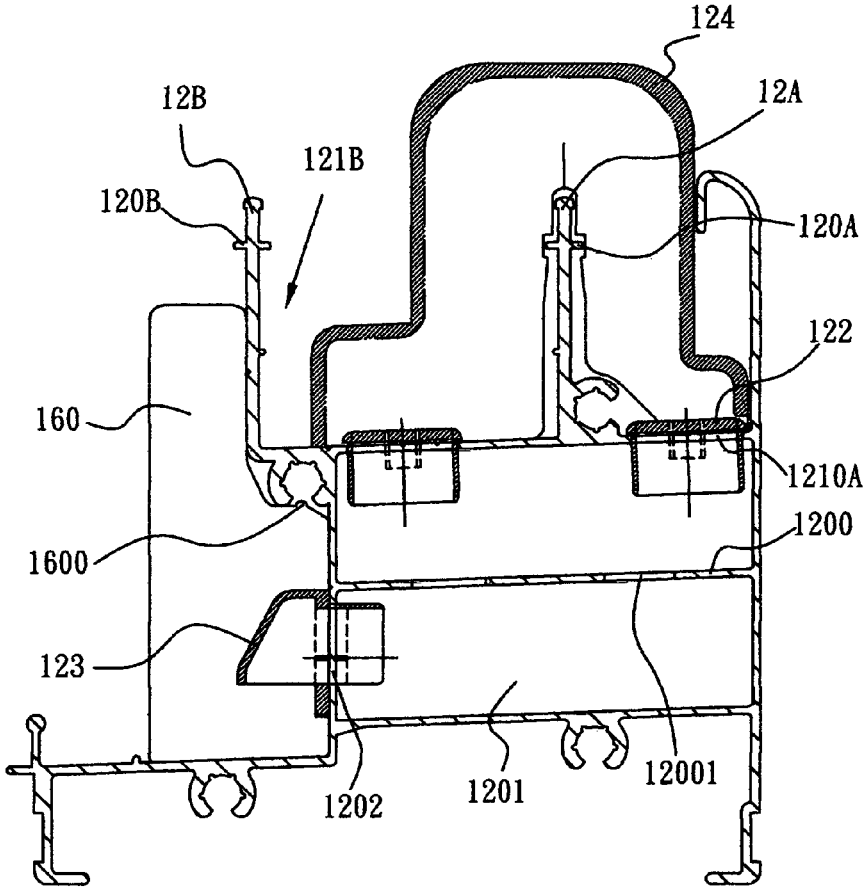
FIG. 30 is a partial side cross-sectional view of FIG. 27.
Figure 31:
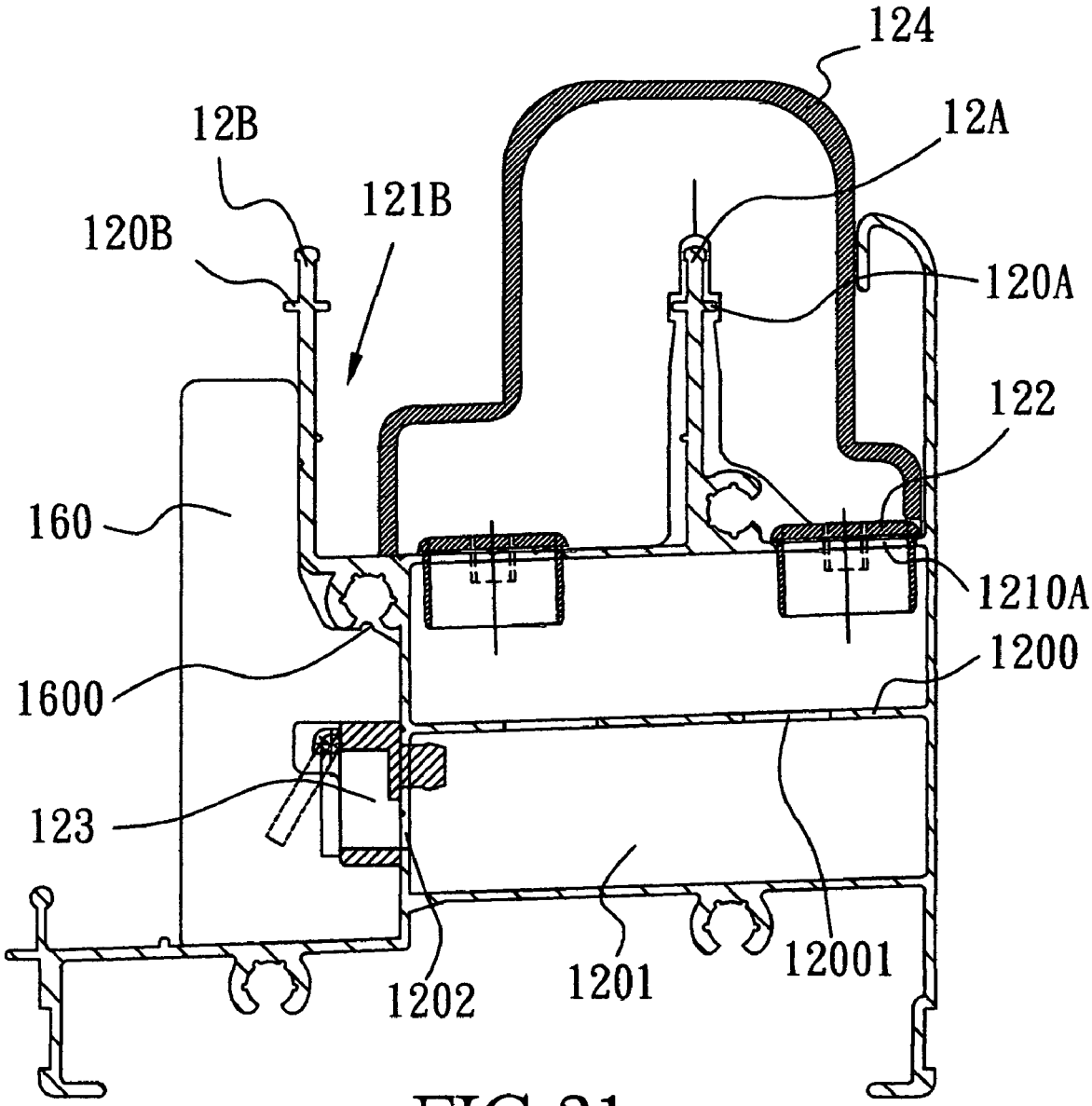
FIG. 31 is a partial side cross-sectional view of FIG. 28.
Figure 32:
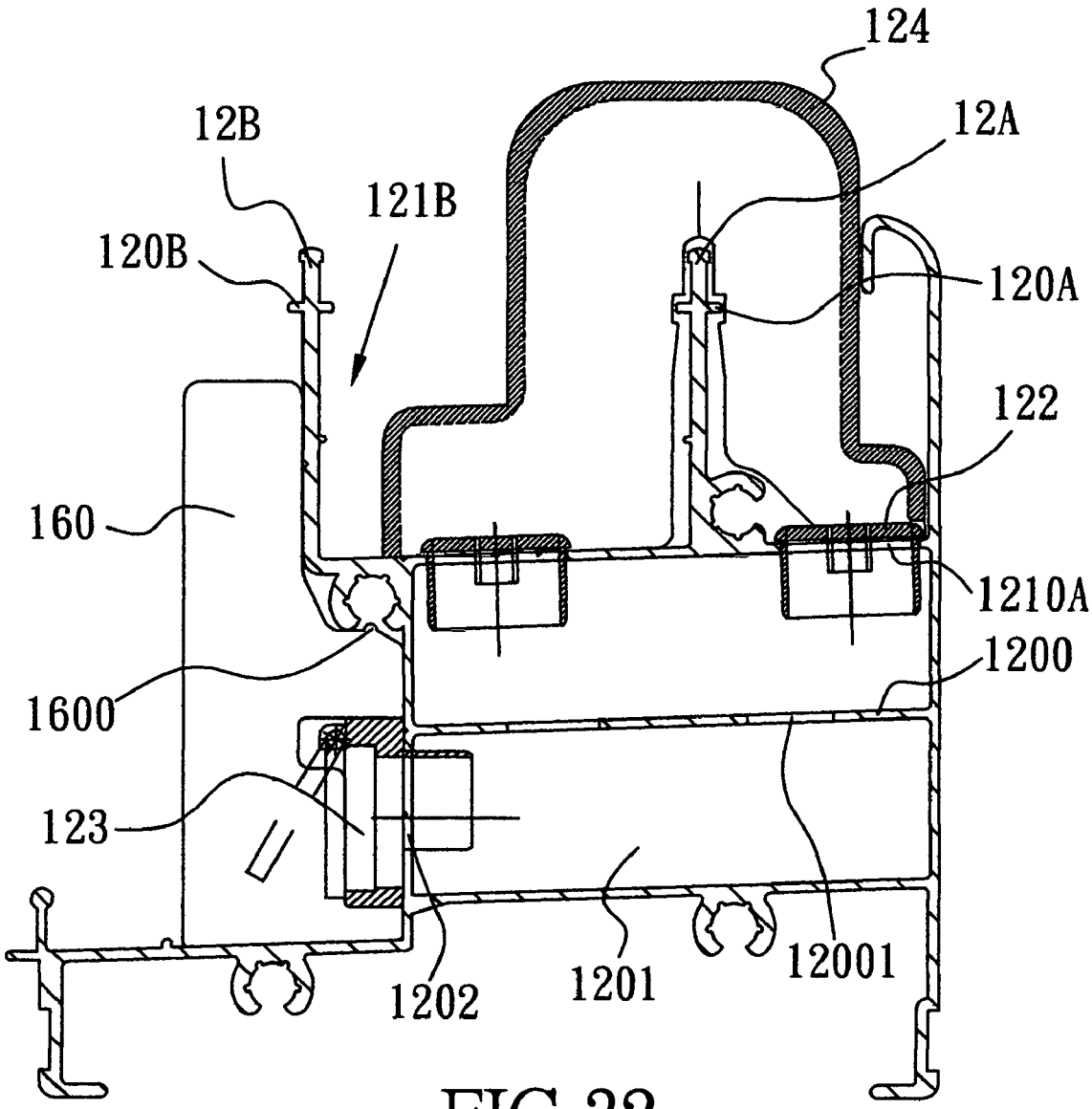
FIG. 32 is a partial side cross-sectional view of FIG. 29.

The draining holes 1210A, 121013 and the water exhausting holes 1202 of the lower frame 12 are respectively provided with a draining hole plug 121, 122 and a hole plug 123. The hole plugs 123 can be designed into different types including unmovable outer-covering hole plugs 123, as shown in FIGS. 27 and 30, or movable outer-covering hole plugs 123, as shown in FIGS. 28, 31 or FIGS. 29, 32. The draining hole plugs 121, 122 and the hole plugs 123 are able to lower the wind pressure produced by strong wind, avoid splashing of rain water and prevent rain water affected by strong wind from flowing backward and external things from getting in the inner draining space 120. In order to prevent rain water affected by strong wind from causing splashing and leaking in a room from the draining hole plugs 121, 122 during water draining, a wind-blocking cover 124 is provided over the draining hole plugs 121, 122 and engaged with the inner window slide rail 12A. The wind-blocking cover 124 has its topside bored with a plurality of wind-exhausting holes 1240 able to lower the wind pressure in the wind-blocking cover 124 to prevent the wind-blocking cover 124 from causing spurting of air bubbles.

In addition, a window screen-blocking member 160 is fitted between the outer window slide rail 12B and the window screen slide rail 12C that a window screen is fitted on. The window screen blocking member 160 is hollow shaped and has its outer side formed with a fixing member 1600 for firmly fixing the window screen blocking member 160 on the outer side of the outer window slide rail 12B and enabling the window screen 16 to slide steadily on the window screen slide rail 12C to prevent the window screen 16 from blown by strong wind to swing and fall off.

Figure 37:
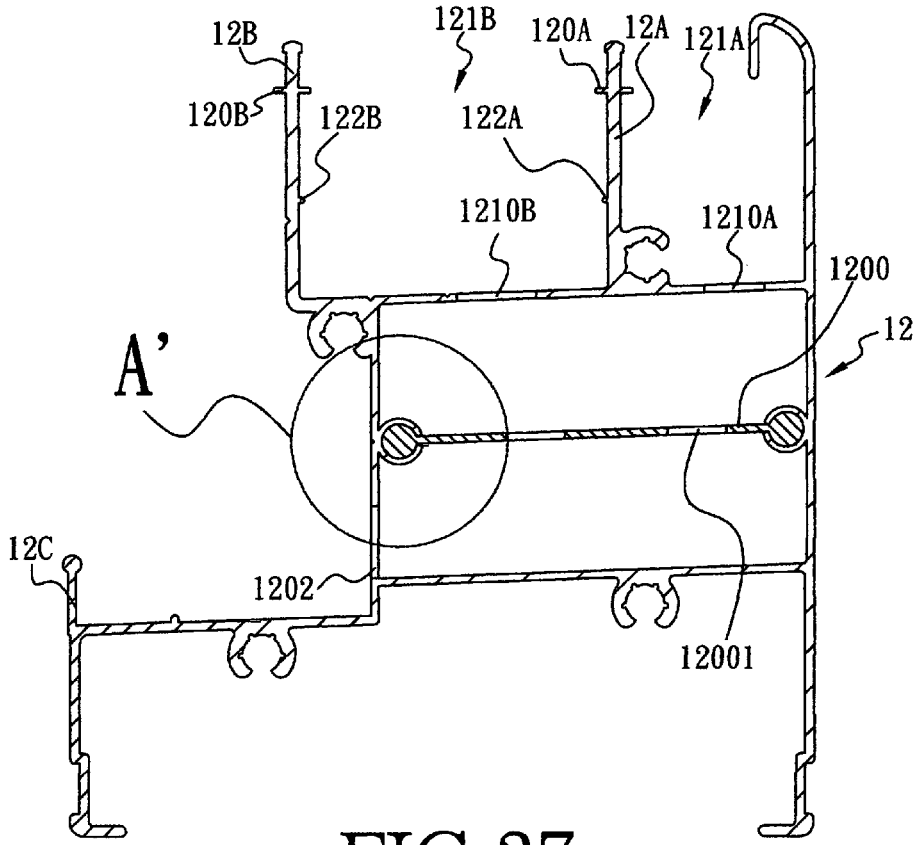
FIG. 37 is a side cross-sectional view of a second preferred embodiment of a lower frame in the present invention.
Figure 43:
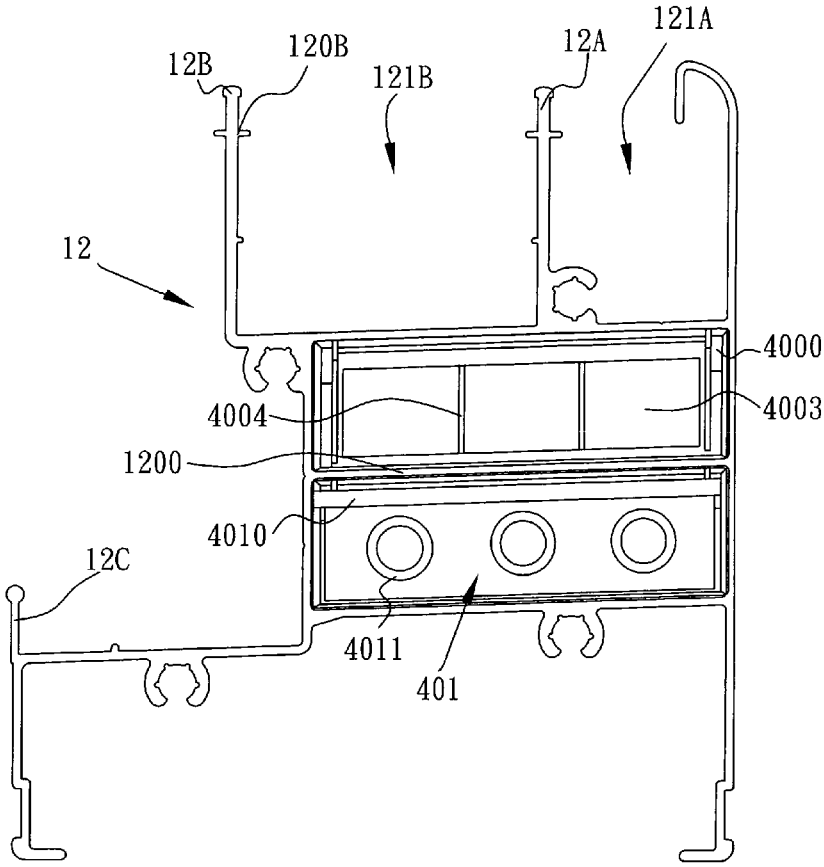
FIG. 43 is a side cross-sectional view of the draining valve in an assembling condition in the present invention.
Figure 48:
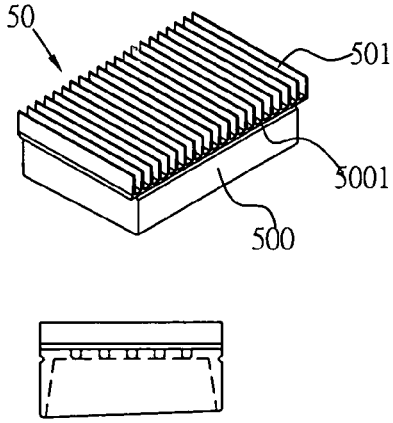
FIG. 48 is a perspective view of a first preferred embodiment of the lower wind-and-rain-stopping block shown in FIG. 46.
Figure 49:
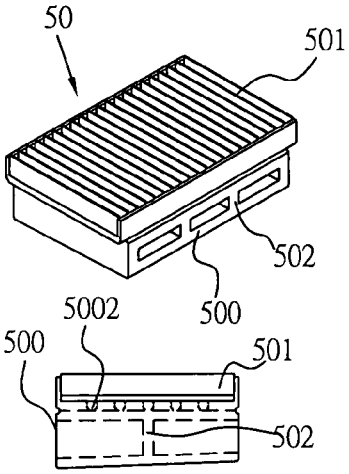
FIG. 49 is a perspective view of a second preferred embodiment of the lower wind-and-rain-stopping block shown in FIG. 46.
Figure 50:
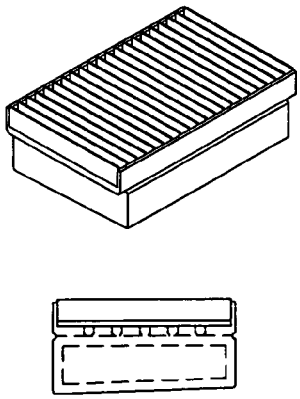
FIG. 50 is a perspective view of a third preferred embodiment of the lower wind-and-rain-stopping block shown in FIG. 46.
Figure 51:
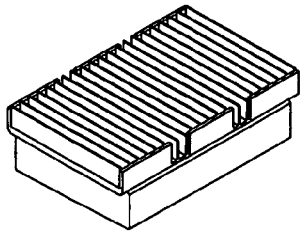
FIG. 51 is a perspective view of a fourth preferred embodiment of the lower wind-and-rain-stopping block shown in FIG. 46.
Figure 52:
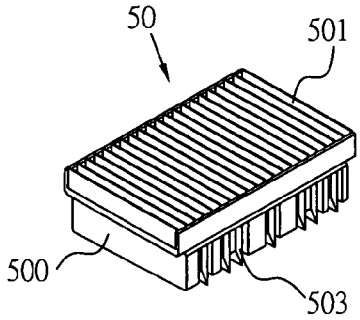
FIG. 52 is a perspective view of a fifth preferred embodiment of the lower wind-and-rain-stopping block shown in FIG. 46.
Figure 53:
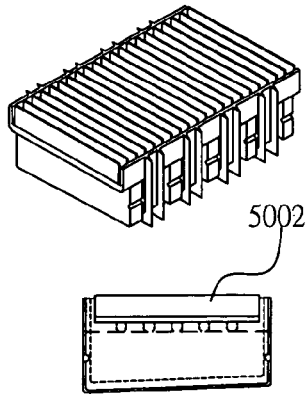
FIG. 53 is a perspective view of a sixth preferred embodiment of the lower wind-and-rain-stopping block shown in FIG. 46.
Figure 57:
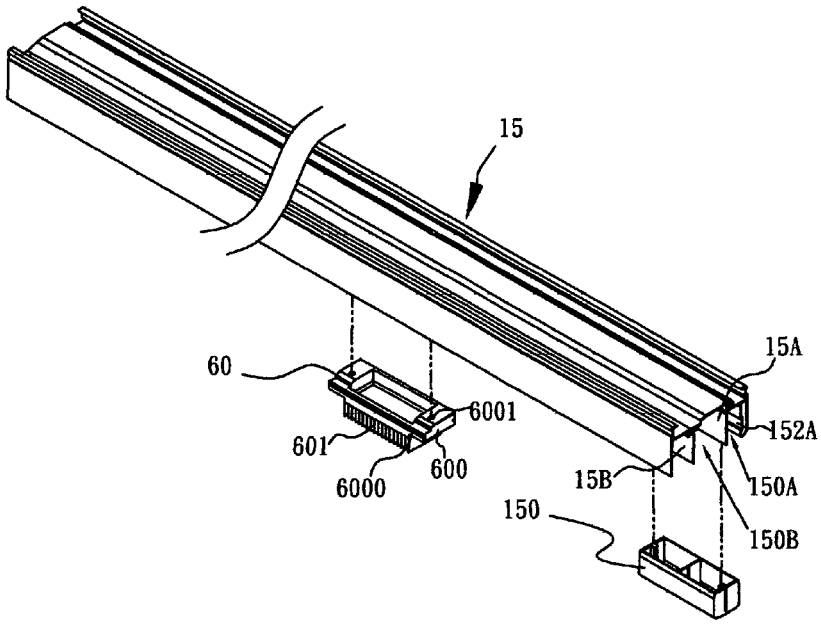
FIG. 57 is perspective views of the upper wind-and-rain-stopping block and the collision-blocking member in an assembling condition in the present invention.
Figure 58:
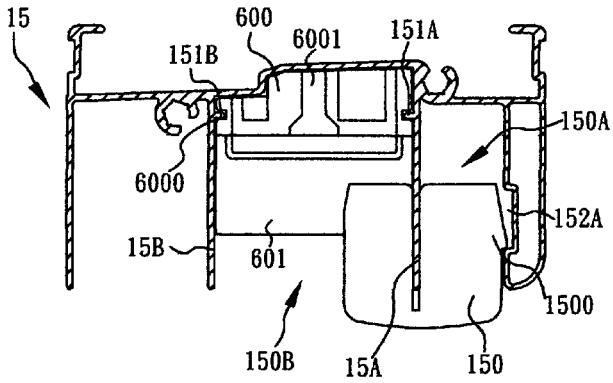
FIG. 58 is a side cross-sectional view of the upper wind-and-rain-stopping block and the collision-blocking member shown in FIG. 57 in an assembling condition.

The separating plates 1200 of the inner draining space 120 of this invention can be combined by mutual engagement and can be shaped as Z or Y, as shown in FIGS. 37 and 38.

The inner draining space 20 of this invention could be a water-exhausting pipe 125 or plural water-exhausting pipes 125 combined together, as shown in FIGS. 39-*a*. 39-*b* 40-*a* and 40-*b*.

The draining valve 40, as shown in FIGS. 41-*a*, 41-*b*, 42-*a*, 42-*b* and 43, is a water-exhausting and wind-blocking device composed of a clogging member 400 and a valve-engaging member 401. The clogging member 400 is a hollow structure having the opposite ends respectively formed with an open end 400A, 400B and a shape matching with the opening of the draining passageway 1201 of the inner draining space 120 of the lower frame 12. The end opening 400A, 400B of the clogging member 400 have their short sides respectively bored with a pivot hole 4000 aligned to each other. The clogging member 400 has its outer side corners respectively bored with an engage groove 4001 able to be slightly pulled for facilitating engagement. Further, the clogging member 400 has its outer peripheral surface provided with a plurality of flexible sheeted clogging members 4002 and its interior formed with a draining groove 4003 having rib-shaped plates 4004 vertically fixed in the interior for reinforcing the clogging member 400.

The valve engaging member 401 of the draining valve 40 is engaged on one of the open end 400A, 400B of the clogging member 400, having its opposite upper side edges respectively secured with a pivot 4010 extending outward and matching with the pivot hole 4000 of the clogging member 400. Further, the valve-engaging member 401 has its front side and reverse side respectively bored with engage holes 4011 fitted therein with a weight-matching member 4012. Thus, when there is no wind and rain, the valve-engaging member 401 will be slightly opened by the action of gravity and the weight member 4012, letting the valve engaging member 401 produce a leverage effect. Furthermore, various weight members 4012 of different weights can let the valve-engaging member 401 formed with different open conditions.

Evidently, as shown in FIGS. 44-*a*, 44-*b* and 44-*c*, the draining valve 40 composed of the clogging member 400 and the valve engaging member 401 is fitted at a proper location in the draining passageway 1201 of the inner draining space 120 of the lower frame 12 for stopping strong wind from pushing the rain water in the draining passageway 1201 to flow backward and get in a room. Substantially, the draining valve 40 enables the draining passageway 1201 of the inner draining space 120 of the lower frame 12 to enhance effects of resistance to wind \and water as well as drainage of rainwater.

Specifically, the lower frame 12 of this invention has its interior formed with the inner draining space 120 partitioned into plural draining passageways 1201 by the separating plates 1200 that are respectively bored with a plurality of flowing holes 12001. The draining passageway 1201 can be fitted therein with one or plural draining valve(s) 40 for partitioning the draining passageway 1201 into several pressure-reducing draining spaces 12010 according to requirements of draining speed, flow volume and direction. The clogging member 400 of the draining valve 40 can be closely fitted in the draining passageway 1201 of the inner draining space 120 by means of its sheet-shaped clogging members 4002 on the peripheral edge. By so designing, when rain water is blocked by the inner and the outer window 10, 11 and flows into the inner and the outer window slide rail groove 121A, 121B of the slanting lower frame 12, it will naturally flow downward into the draining passageway 1201 in the inner draining space 120 through the draining holes 1210A, 1210B of the inner and the outer window slide rail groove 121A, 121B and be blocked by the draining valve 40 that has its valve engaging member 401 provided at a position opposite to the flowing direction of the draining passageway 1201. The weight-matching member 4012 fitted on the valve-engaging member 401 enables the valve-engaging member 401 to keep slightly open normally when there is no water pressure.

Additionally, the draining passageway 1201 is partitioned into several pressure-reducing draining spaces 12010; therefore, when rain water in the pressure-reducing draining space 12010 incessantly increases and the wind pressure and water pressure in the pressure-reducing draining space 12010 are released out gradually through the water-exhausting holes 1202, water capacity in the pressure-reducing space 12010 will decrease by degrees. When the water pressure in the pressure-reducing draining space 12010 is great enough to resist wind pressure or greater than the wind pressure, the valve engaging member 401 can be smoothly pushed open by the water pressure produced by the rain water and by the action of the weight member 4012, and thus the rain water can smoothly flow to the next draining valve 40 or directly flow to the water-exhausting hole 1202 of the lower frame 12 to be drained out. On the contrary, when wind pressure is greater than water pressure, the valve-engaging member 401 will be closed immediately by the wind pressure and the weight of the weight 4012.

By so designing, not only can rain water be drained out, but also the opportunity of water draining and the flow volume of rain water can be controlled when water pressure and wind pressure reach to an equilibrium, and the draining valves 40 in the draining passageway 1201 of the inner draining space 120 will never be affected by external strong wind. Therefore, the flow volume of rain water drained out of the draining passageway 1201 can be controlled and rain water in the draining passageway 1201 can be drained out continuously and water pressure can also be controlled to resist wind pressure so as to prevent rain water blown by strong wind from flowing backward. Thus, the draining space 120 formed in the lower frame 12 and the draining valves 40 fitted in the draining passageway 1201 enable the lower frame 12 to form a water draining system having excellent effects of drainage and resistance to both wind pressure and water pressure.

Moreover, the valve of the draining valve 40 can be designed into a single plate, as shown in FIGS. 45-*a* and 45-*b*.

The lower wind-and-rain-stopping block 50, as shown in FIGS. 46-*a*, 46-*b*, 46-*c*, 47-*a*, 47-*b*, 47-*c*, 47-*c*, 54-*a* and 54-*b*, is fitted at a proper location of an intermediate portion in the outer window slide rail groove 121B of the lower frame 12. The lower wind-and-rain-stopping block 50 is composed of an engage block 500 and a sheet blocking member 501. The engage block 500 is bored with one or more elongate engage recess 5001 in the opposite side walls abutting the inner and the outer window slide rail 12A, 12B to be respectively engaged with the elongate engage projection 122A, 122B on the inner and the outer window slide rail 12A, 12B to position the lower wind-and-rain-stopping block 50 on the lower frame 12. The engage block 500 is further bored with a plurality of conical through holes 5002. The sheeted blocking member 501 is completely and closely contacted with the bottom seating plate 201 of the covering-and-clogging casing 20. Thus, when rain water is blocked by the sheeted blocking member 501 and drops to the engage block 500, it will flow into the outer window slide rail groove 121B through the conical through holes 5002 of the engage block 500, preventing rain water from flowing in a room through the gaps formed at the overlapping portions of the inner and the outer window 10, 11 when they are closed.

The lower wind-and-rain-stopping block 50 can be designed into various types in accordance with different functions, as shown in FIGS. 48 to 53. The engage block 500 of the lower wind-and-rain-stopping block 50 can be formed with a hollow interior provided therein with plural vertical ribs 502 for reinforcing the structure. Further, the engage block 500 can have its side edge provided with sheeted clogging member 503 for reinforcing joint status. The sheeted clogging member 503 is made of a flexible material and is a little higher than the engage block 500. Thus, when the engage block 500 or the lower frame 12 is compressed and distorted, the engage block 500 still can be firmly positioned in the outer window slide rail groove 121B.

The upper frame 15, as shown in FIGS. 55-*a*, 55-*b*, 55-*c*, 56-*a*, 56-*b*, 56-*c* 56-*d*, 57 and 58, has its lower side surface formed with an inner window slide-guiding member 15A and an outer window slide-guiding member 15B respectively having one side formed with an accommodating groove 150A, 150B. The inner and the outer window slide-guiding member 15A, 15B are respectively formed with an engage member 151A, 151B positioned in the accommodating groove 150B and facing each other. A upper wind-and-rain-stopping block 60 is fitted in the accommodating groove 150B at an intermediate portion of the upper frame 15 and is composed of an engage member 600 and a sheeted blocking member 601. The engage member 600 has its opposite outer sides respectively bored with an engage groove 6000 to be engaged with the engage member 151A, 151B of the upper frame 15 for firmly positioning the engage member 600 of the upper wind-and-rain-stopping block 60 on the upper frame 15. The engage member 600 is further bored with a screw hole 6001 for a screw 80 to be screwed therethrough for locking and positioning the engage member 600 in the accommodating groove 151B of the upper frame 15. The upper wind-and-rain-stopping block 60 is not to be moved in the accommodating groove 150B whether the inner and the outer windows are opened or closed.

The sheet blocking member 601 formed integral with the engage member 600 and extending upward is to be closely contacted with the bottom sealing plate 201 of the covering-and-clogging casing 20 fitted at the joint corner of the inner and the outer windows 10, 11. By mutually close contact of the sheet blocking member 601 of the upper wind-and-rain-stopping block 60 and the covering-and-clogging casing 20, rain water can be stopped from getting in the joint corner of the inner and the outer windows 10, 11, having the best effect of prevention of both wind and rain.

The inner window slide-guiding member 15A is fitted thereon with a collision-preventing member 150 at a location a butting the side frame 14. The collision-preventing member 150 has its outer side surface formed with an engage member 1500 to be engaged with the engage groove 152A bored in one side of the accommodating groove 150A abutting the inner window slide-guiding member 15A for positioning the collision-preventing member 150 in the inner window slide-guiding member 15A and preventing it from falling off the upper frame 15. The collision-preventing member 150 is provided for preventing the side frame 14 from being collided and distorted by the inner window 10 when the inner window 10 is pushed open by an excessively great force.

Figure 59:
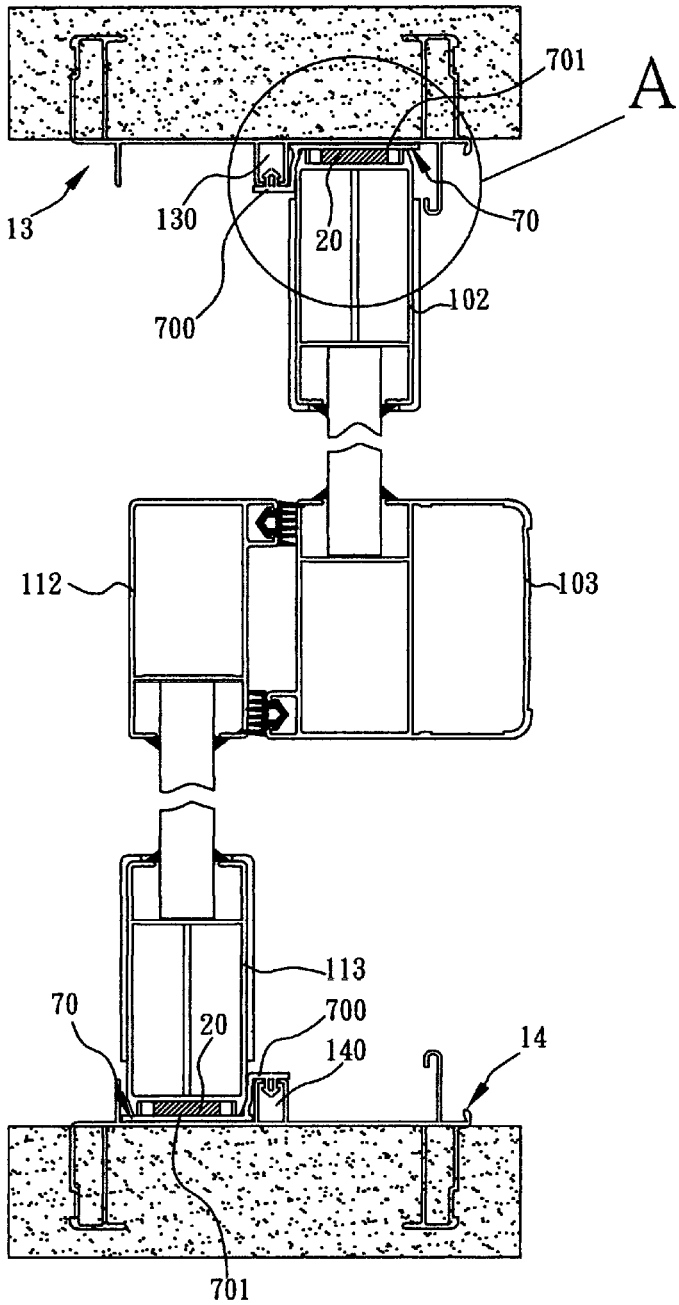
FIG. 59 is an upper view of collision-preventing and airtight elongate members in an assembling condition in the present invention.

In addition, as seen in FIGS. 59, 60-*a*. and 60-*b*, a collision-preventing and airtight elongate member 70 is respectively fixed on the two side frame 13, 14 at the location abutting the upper frame 15. The collision-preventing and airtight elongate member 70 is composed of an engage portion 700 and an airtight portion 701. The two symmetrical side frames 13, 14 have their inner surface respectively bored with an engage groove 130, 140 for respectively receiving the engage portions 700 of the collision-preventing and airtight elongate members 70 and positioning the two collision-preventing and airtight elongate members 70 on the two side frames 13, 14. The airtight portion 701 of the collision-preventing and airtight elongate member 70 is a flat and elastic plate; therefore, when the inner and the outer windows 10, 11 are closed, the airtight portion 701 will be compressed to closely push against the front blocking plate 202 of the covering-and-clogging casing 20 to form a completely airtight condition for blocking wind and rain. Additionally, the airtight portion 701 can also serve as a buffer to lessen the impact force when the inner and the outer windows 10, 11 are closed so as to prevent the side frames 13, 14 from distorting. The airtight portions 701 of the collision-preventing and airtight elongate member 70 are able to recover the original state instantly when the inner and the outer windows 10, 11 are pushed open. The collision-preventing and airtight elongate member 70 enables the inner and the outer windows 10, 11 to make up a window structure having functions of prevention of wind and rain, resistance of wind pressure and air tightness.

In addition, as shown in FIGS. 61-*a*, 61-*b*, 61-*c* and 61-*d*, the collision-preventing and airtight elongate member 70 can be provided with a plurality of elastic ribs 702 to have the collision-preventing and airtight elongate member 70 formed with a plurality of compression spaces 703, equally having functions of prevention of collision and air tightness when the windows 10, 11 are closed.

While the preferred embodiments of the invention have been described above, it will be recognized and understood that various modifications may be made therein and the appended claims are intended to cover all such modifications that may fall within the spirit and scope of the invention.

The invention claimed is:

1. A wind and rain preventing device for aluminum doors and windows comprising a window structure which comprises an inner window, an outer window, a lower frame, two side frames and an upper frame, said inner and outer windows having peripheral edges and joint corners, said lower frame having a topside surface thereof with an inner window slide rail and an outer window slide rail formed thereon, each of said inner window slide rail and outer window slide rail having opposite sides formed thereon respectively, said wind and rain preventing device comprising a plurality of sets of covering-and-clogging casings respectively fitted at all said joint corners of the peripheral edges of said inner and said outer windows, said inner and outer window slide rails having the opposite sides formed thereon with an elongate projecting member, said covering-and-clogging casing having one side engaging with said inner and said outer window slide rails and being able to move thereon, said covering-and-clogging casing further comprises a clogging body, a bottom sealing plate and a front blocking plate, said clogging body has a short side with a locking hole formed thereon, so as to enable a screw being screwed in said locking hole to combine said lower and side window frames, said clogging body further comprises a slide-guiding member formed beneath said locking hole; said bottom sealing plate connected with said clogging body and able to completely cover up all said joint corners and having a central portion of an underside of said bottom sealing plate bored with a slide rail groove to be engaged with said window slide rail, said bottom sealing plate having its opposite sides respectively formed with a projecting member extending up, said front blocking plate and said slide-guiding member connected together; said front blocking plate connected with a slide-guiding member and having an adjusting hole formed thereon, said front blocking plate having its lower edge disposed with a fin-shaped water-blocking member.

2. The wind and rain preventing device for aluminum doors and windows as claimed in claim 1, wherein said covering-and-clogging casing is composed of said clogging body and said bottom sealing plate and said front blocking plate combined as integral.

3. The wind and rain preventing device for aluminum doors and windows as claimed in claim 1, wherein said covering-and-clogging casing is installed on flat-stepped or differently stepped windows.

4. The wind and rain preventing device for aluminum doors and windows as claimed in claim 1, wherein said covering-and-clogging casing is designed for matching with joint corners of the peripheral edges of said inner and said outer windows.

5. The wind and rain preventing device for aluminum doors and windows as claimed in claim 1, wherein said adjusting hole of said covering-and-clogging casing is provided for adjusting the positions of rollers.

6. The wind and rain preventing device for aluminum doors and windows as claimed in claim 1 or 5, wherein said adjusting hole of said covering-and-clogging casing is fitted thereon with a fin-shaped hole member made of plastic for stopping rain water and soil from getting into said adjusting hole, said fin-shaped hole member being capable of recovering to an initial shape and position after said fin-shaped hole member is pulled along with said covering-and-clogging casing.

* * * * *